US008506060B2

(12) United States Patent
Tamaki

(10) Patent No.: US 8,506,060 B2
(45) **Date of Patent: *Aug. 13, 2013**

(54) INK SUPPLY DEVICE FOR INKJET PRINTER AND INKJET PRINTER

(75) Inventor: Kazutaka Tamaki, Tomi (JP)

(73) Assignee: Mimaki Engineering Co., Ltd., Tomi-Shi (JP)

( * ) Notice: Subject to any disclaimer, the term of this patent is extended or adjusted under 35 U.S.C. 154(b) by 604 days.

This patent is subject to a terminal disclaimer.

(21) Appl. No.: 12/822,141

(22) Filed: Jun. 23, 2010

(65) Prior Publication Data

US 2010/0295905 A1 Nov. 25, 2010

Related U.S. Application Data

(63) Continuation of application No. PCT/JP2009/057663, filed on Apr. 16, 2009.

(30) Foreign Application Priority Data

Apr. 16, 2008 (JP) ..... 2008-106919
Apr. 16, 2008 (JP) ..... 2008-106920
Apr. 18, 2008 (JP) ..... 2008-109087

(51) Int. Cl.
*B41J 2/175* (2006.01)
*B41J 29/393* (2006.01)

(52) U.S. Cl.
USPC ..... 347/85; 347/7

(58) Field of Classification Search
USPC ..... 347/7, 84, 85, 86
See application file for complete search history.

(56) References Cited

U.S. PATENT DOCUMENTS 5,155,528 A * 10/1992 Morishige et al. ..... 399/64
6,623,092 B2 * 9/2003 Kim et al. ..... 347/7
6,739,712 B2 * 5/2004 Kim ..... 347/87
6,957,882 B2 * 10/2005 Wouters et al. ..... 347/86
7,901,063 B2 * 3/2011 Wouters et al. ..... 347/89
8,047,640 B2 * 11/2011 Uchiyama et al. ..... 347/85
8,104,855 B2 * 1/2012 Tamaki et al. ..... 347/7
8,142,003 B2 * 3/2012 Tamaki ..... 347/92

FOREIGN PATENT DOCUMENTS

JP 08-132640 5/1996
JP 11-188890 7/1999
JP 2000-296625 10/2000
JP 2001-141547 5/2001
JP 2001-225482 8/2001

(Continued)

OTHER PUBLICATIONS

International Search Report for International Application No. PCT/JP2009/057663, May 19, 2009.

*Primary Examiner* — Anh T. N. Vo
(74) *Attorney, Agent, or Firm* — Ditthavong Mori & Steiner, P.C.

(57) ABSTRACT

An ink supply device for an inkjet printer includes a sub-tank and a main tank. The sub-tank has an ink chamber to store liquid ink and is connected to a print head configured to eject the liquid ink via a head-side supply passage. The sub-tank has a plurality of supply holes which connect the ink chamber and the head-side supply passage. At least two of the plurality of supply holes have their openings on the ink chamber side formed at different heights. The main tank is connected to the sub-tank and contains the liquid ink to be supplied to the ink chamber.

15 Claims, 15 Drawing Sheets

(56) References Cited

FOREIGN PATENT DOCUMENTS

| | | |
|---|---|---|
| JP | 2002-160383 | 6/2002 |
| JP | 2004-284207 | 10/2004 |
| JP | 2006-062330 | 3/2006 |
| JP | 2006-168341 | 6/2006 |
| JP | 2006-247862 | 9/2006 |
| JP | 2007-216535 | 8/2007 |

* cited by examiner

INK SUPPLY DEVICE FOR INKJET PRINTER AND INKJET PRINTER

CROSS-REFERENCE TO RELATED APPLICATIONS

The present application is a continuation application of International Application No. PCT/JP2009/057663, filed Apr. 16, 2009, which claims priority to Japanese Patent Application No. 2008-106919, filed Apr. 16, 2008, Japanese Patent Application No. 2008-106920, filed Apr. 16, 2008, and Japanese Patent Application No. 2008-109087, filed Apr. 18, 2008. The contents of these applications are incorporated herein by reference in their entirety.

BACKGROUND OF THE INVENTION

1. Field of the Invention

The present invention relates to an ink supply device for an inkjet printer and an inkjet printer.

2. Discussion of the Background

An inkjet printer is an apparatus which forms images of information such as characters, graphics, patterns, and photographs on a print surface by ejecting fine particles of ink from a plurality of nozzles, which are formed in a print head, to deposit the ink on a print medium while moving the print head relative to the print medium. Because of the structure, as the inkjet printer has remained in the non-operating state for a long period of time, ink residual thickens around nozzle peripheries of the print head, thus not allowing the ink to be ejected properly. For solving this problem, there is an inkjet printer which includes a suction route for performing forcible vacuum suction of ink remaining in the print head in the state that the nozzle face of the print head is capped by a rubber cap, for example, on start-up (for example, see JP-A-2007-216535). In this way, thickening ink is sucked and removed and, at the same time, new ink is supplied into the print head, thereby reestablishing the print head to a state that ink can be ejected properly.

Further, in the inkjet printer, since ink is consumed according to the ejection of the ink, a carriage of the print head or a printer body is provided with an ink tank (ink cartridge) having a volume based on the intended use. In case of a large-sized inkjet printer for printing large commercial advertisements, banners, and the like, a large amount of ink is consumed in a relatively short time. In such a large-sized inkjet printer, therefore, a large volumetric ink tank (main tank) is generally provided in the printer body, and the ink tank and the print head are connected through tubes or the like so as to supply ink from the ink tank to the print head.

However, as the inner pressure of the print head becomes higher than the normal atmospheric pressure, a problem that ink is pushed out of nozzles to drip onto a print medium, i.e. a dripping problem occurs. To solve this problem, there is known an ink supply device of a "negative pressure producing type" which includes a sub-tank of a smaller volume disposed at the supply passage connecting main tank and print head, in which the print head is made into a state of slight negative pressure by reducing the pressure of the sub-tank (see, for example, JP-A-2004-284207 and JP-A-2006-62330).

The ink supply device of the aforementioned type is controlled such that a predetermined amount of ink is stored in the ink chamber of the sub-tank according to the amount of ink ejected from the nozzles to prevent interruption of ink supply to the print head. As one example of the control, it is controlled to supply ink from the main tank to the sub-tank when the ink level in the sub-tank is detected to be lowered to a predetermined lower limit. As a regular means of detecting the ink level, a structure has been disclosed in which a float provided with a magnet is vertically movably placed to float on ink and a sensor for detecting magnetism from the magnet is disposed at a predetermined level (for example, JP-A-2001-141547).

In addition, a pressure controller connected to the ink chamber of the sub-tank is usually provided in the ink supply device to adjust the pressure within the ink chamber. For example, it reduces the inner pressure of the ink chamber by sucking air from the inside of the ink chamber to set the print head at a state of slight negative pressure. The pressure adjustment becomes difficult if ink flows into the connector channel connecting the sub-tank and the pressure controller, and a dripping problem is likely to occur. Thereby, when, for example, the ink level excesses an upper limit in the ink chamber, it is controlled to prevent ink from the main tank from being supplied to the sub-tank.

As aforementioned, the nozzle face of the print head is capped for achieving the suction of ink, however, if for example there is a displacement between the nozzle face and the rubber cap, suction force may be reduced because air enters through a space between the nozzle face and the rubber cap. In this case, ink residual within the print head is sucked and removed, but new ink is hardly supplied to the print head so that the print head tends to be in a state containing (air) bubbles and consequently being not filled with ink. If the ink is ejected from the nozzles in this state, there is a problem that it is difficult to achieve stable ejection of ink because defective ejection occurs in which air bubbles not ink are ejected from the nozzles.

To precisely detect the ink level by the float which floats on the ink to move straight in the vertical direction according to the changes of the ink level in the sub-tank, it is required to use a large float, for example, corresponding to the volume of the ink chamber. If such a large float is used, it is possible to detect precisely the ink level in the sub-tank, but there is a problem of limiting the volume for ink storage.

Besides, the float used for detecting the ink level in the sub-tank may stick to the internal wall of the ink chamber, which makes it impossible to correctly detect the ink level. In this case, it is difficult to control the ink supply which is based on the correct detection of the ink level, and the ink is undesirably supplied to excess the predetermined upper limit. There is a problem that, when the ink is supplied over the predetermined upper limit to the ink chamber, the excessively supplied ink may flow to the side of the pressure controller (such flow of ink is referred to thereafter as "backflow"), making difficult the pressure adjustment within the ink chamber.

SUMMARY OF THE INVENTION

According to one aspect of the present invention, an ink supply device for an inkjet printer includes a sub-tank and a main tank. The sub-tank has an ink chamber to store liquid ink and is connected to a print head configured to eject the liquid ink via a head-side supply passage. The sub-tank has a plurality of supply holes which connect the ink chamber and the head-side supply passage. At least two of the plurality of supply holes have their openings on the ink chamber side formed at different heights. The main tank is connected to the sub-tank and contains the liquid ink to be supplied to the ink chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
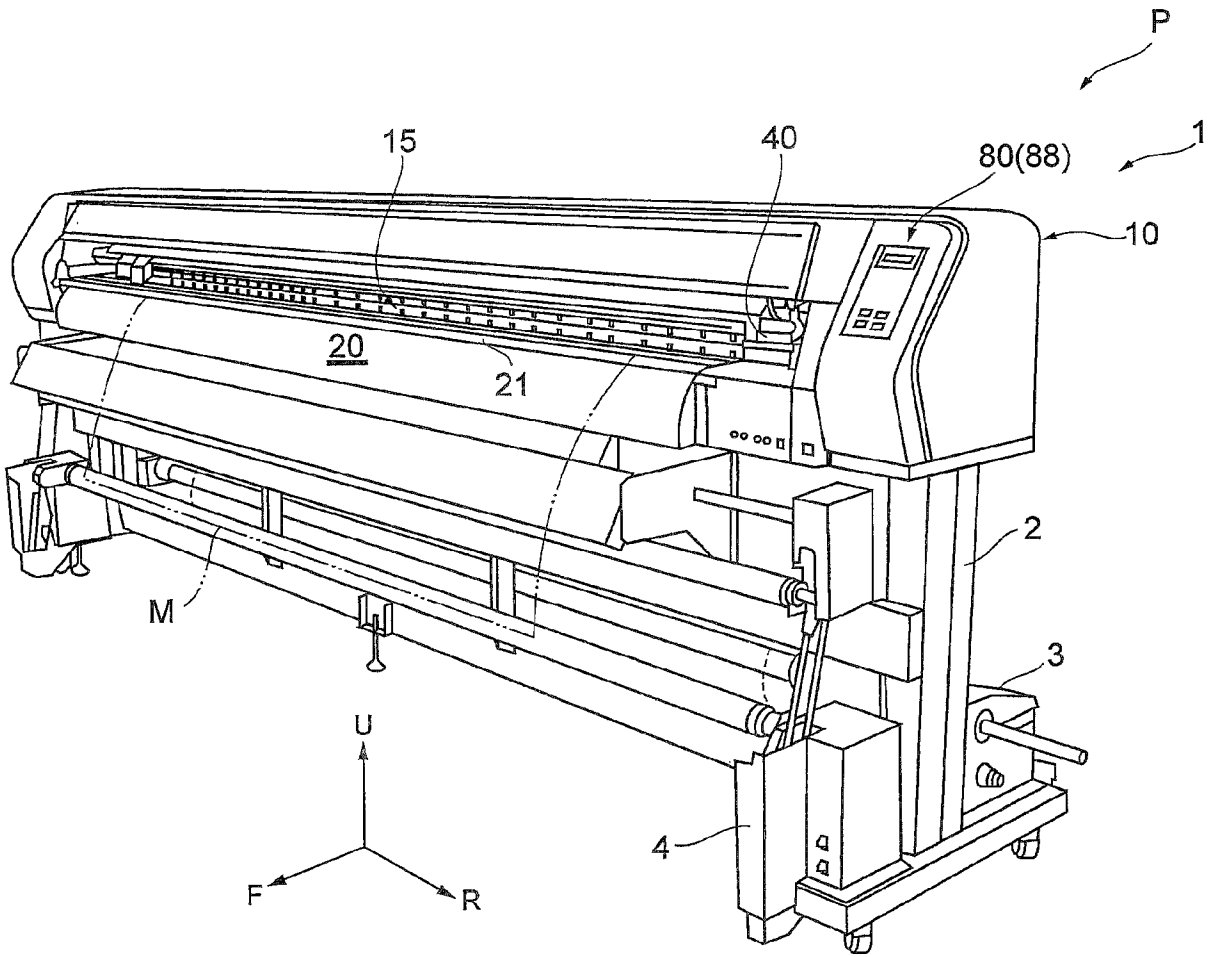
FIG. 1 is an external perspective view showing a printer apparatus according to an embodiment of the present invention as seen diagonally from the front.

Embodiment 1 and 2 will now be described with reference to the accompanying drawings, wherein like reference numerals designate corresponding or identical elements throughout the various drawings.

Embodiment 1

Figure 2:
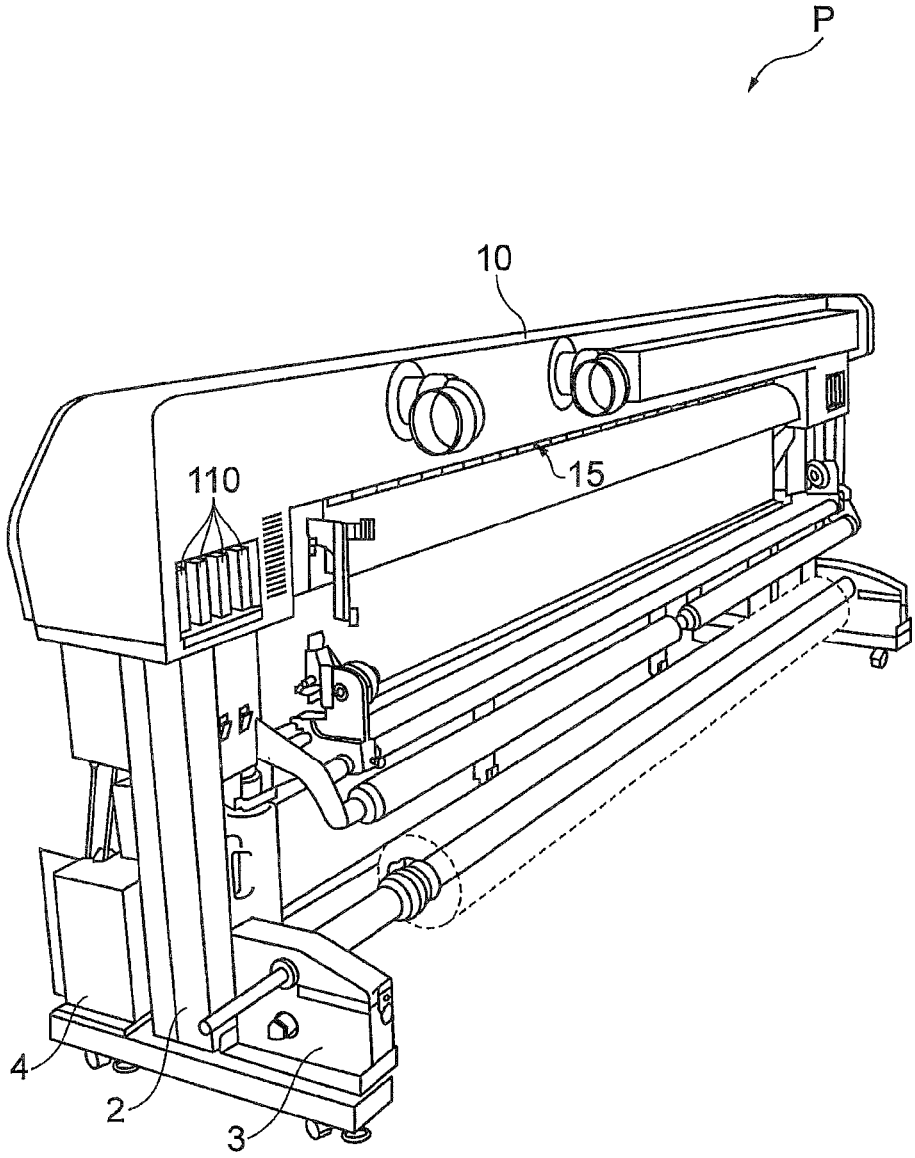
FIG. 2 is an external perspective view showing the printer apparatus as seen diagonally from the back.
Figure 3:
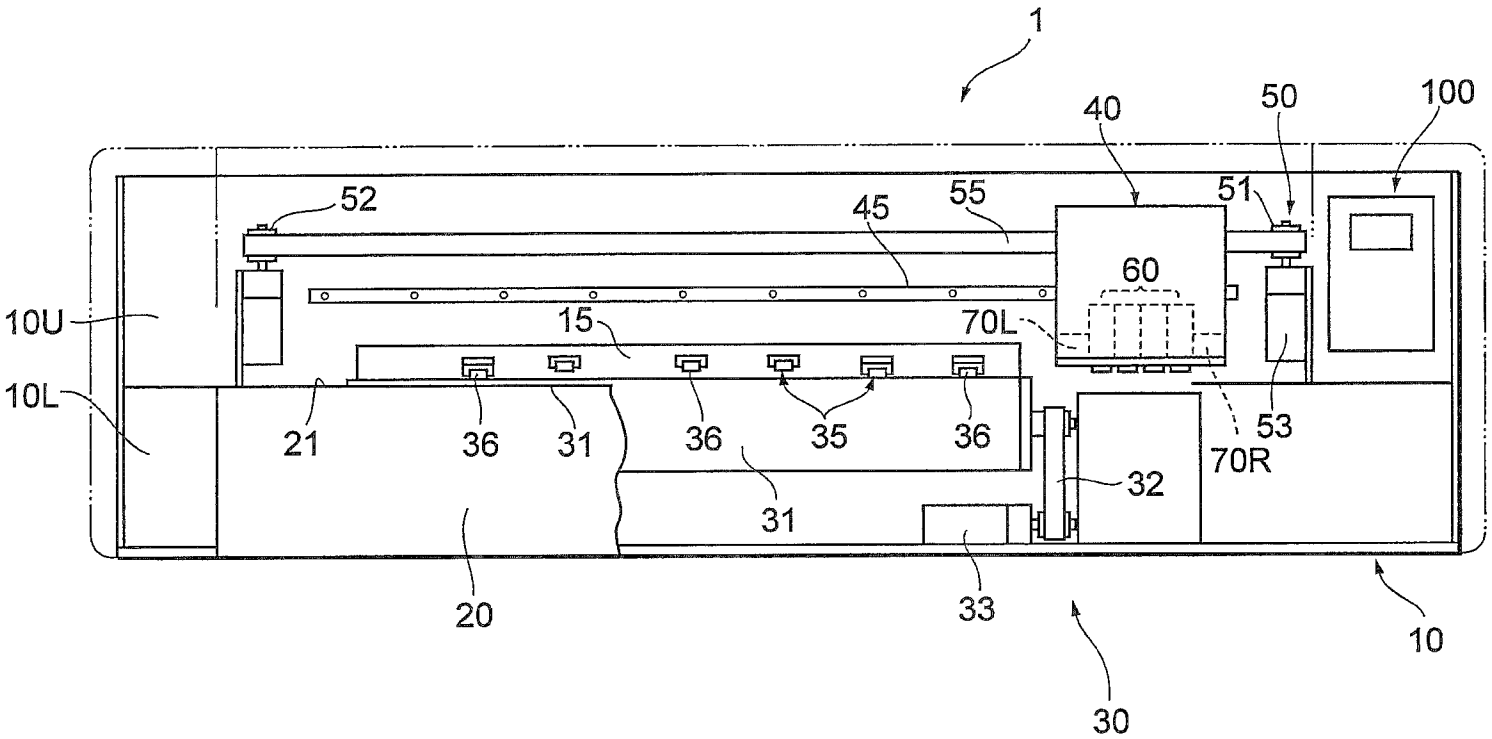
FIG. 3 is a front view showing the structure of main components of an apparatus body of the printer apparatus.

As an example of inkjet printers to which an embodiment of the present invention is applied, a structural example of an inkjet printer of a UV curable type (hereinafter, referred to as "printer apparatus") is employed in the following description. The structural example has orthogonal axes extending along a print surface of which one is used for moving a print medium and the other one is used for moving a print head, and uses an ultraviolet curable ink (so-called "UV ink) which is cured by an irradiation with ultraviolet light. FIG. 1 is a perspective view showing a printer apparatus P of this embodiment as seen diagonally from the front, FIG. 2 is a perspective view showing the same as seen diagonally from the back, and FIG. 3 shows the structure of main components of an apparatus body 1 of the printer apparatus P. First, the entire structure of the printer apparatus P will be outlined with reference to these drawings. In the following description, the directions indicated by arrows F, R, and U in FIG. 1 will be forward, rightward, and upward directions, respectively.

The printer apparatus P mainly includes the apparatus body 1 for conducting the image forming function, a feeding mechanism 3 which is disposed in front of and behind a supporting portion 2 supporting the apparatus body 1 to feed a print medium M from the non-printed rolled state, and a winding mechanism 4 for winding up the print medium M in the printed state.

The apparatus body 1 includes a frame 10 forming the body frame. The frame 10 has a landscape window-like medium through portion 15 which is formed at a middle portion in the vertical direction of the frame 10 and through which the print medium M is passed in the anteroposterior direction. The frame 10 includes a lower frame 10L, which is positioned on the lower side of the medium through portion 15 and is provided with a platen 20 for supporting the print medium M and a medium moving mechanism 30 for moving the print medium M supported by the platen 20 in the anteroposterior direction, and an upper frame 10U, which is positioned on the upper side of the medium through portion 15 and is provided with a carriage 40 holding the print head 60 and a carriage moving mechanism 50 for moving the carriage 40 in the lateral direction. The apparatus body 1 is provided with a control unit 80 for controlling the operations of respective components of the printer apparatus P such as the anteroposterior movement of the print medium M by the medium moving mechanism 30, the lateral movement of the carriage 40 by the carriage moving mechanism 50, the ink ejection by the print head 60, and the ink supply by an ink supply device 100 as will be described later. In addition, an operational panel 88 is disposed in front of the apparatus body 1.

The platen 20 is mounted on the lower frame 10L to extend in the anteroposterior direction below the medium through portion 15 and has a medium supporting portion 21 for supporting the print medium M horizontally in an image forming area of a band-like shape extending in the lateral direction for the print head 60. The medium supporting portion 21 has a large number of small suction holes formed therein which are connected to a decompression chamber (not shown) formed below the medium supporting portion 21. When the decompression chamber is set to have a negative pressure by the action of a vacuum generator, the print medium M is sucked to stick to the medium supporting portion 21 so as to prevent displacement of the print medium M during printing.

The medium moving mechanism 30 includes a cylindrical feeding roller 31 which is disposed such that an upper periphery is exposed to the platen 20 and which extends in the lateral direction, a roller driving motor 33 for driving by rotating the feeding roller 31 via a timing belt 32, and the like. Above the feeding roller 31, a plurality of roller assemblies 35, each having a pinch roller 36 freely rotating in the anteroposterior direction, are disposed to be aligned in the lateral direction. The roller assemblies 35 are adapted to have a cramping position where the pinch rollers 36 are pressed against the feeding roller 31 and an unclamping position where the pinch rollers 36 are spaced apart from the feeding roller 31. By way of driving by rotating the roller driving motor 33 in a state that the roller assemblies 35 are set at the clamping position so that the print medium M is cramped between the pinch rollers 36 and the feeding roller 31, the print medium M is fed for a distance corresponding to the rotational angle of the feeding roller 31 (a drive control value outputted from the control unit 80) in the anteroposterior direction. It should be noted that the state where the roller assemblies 35 are set at the clamping position and the state where the roller assemblies 35 are set at the unclamping position are both shown in FIG. 3.

A guide rail 45 is attached to the upper frame 10U extending parallel to the feeding roller 31 and the carriage 40 is supported on the guide rail 45 via a slide block (not shown) such that the carriage 40 can freely move in the lateral direction. The carriage 40 is driven by a carriage moving mechanism 50 as will be described in the following. In the carriage 40, the print head 60 for ejecting UV ink is disposed such that a nozzle face as the lower face of the head is spaced apart from the medium supporting portion 21 of the platen 20 by a predetermined gap to face the same.

Figure 5:
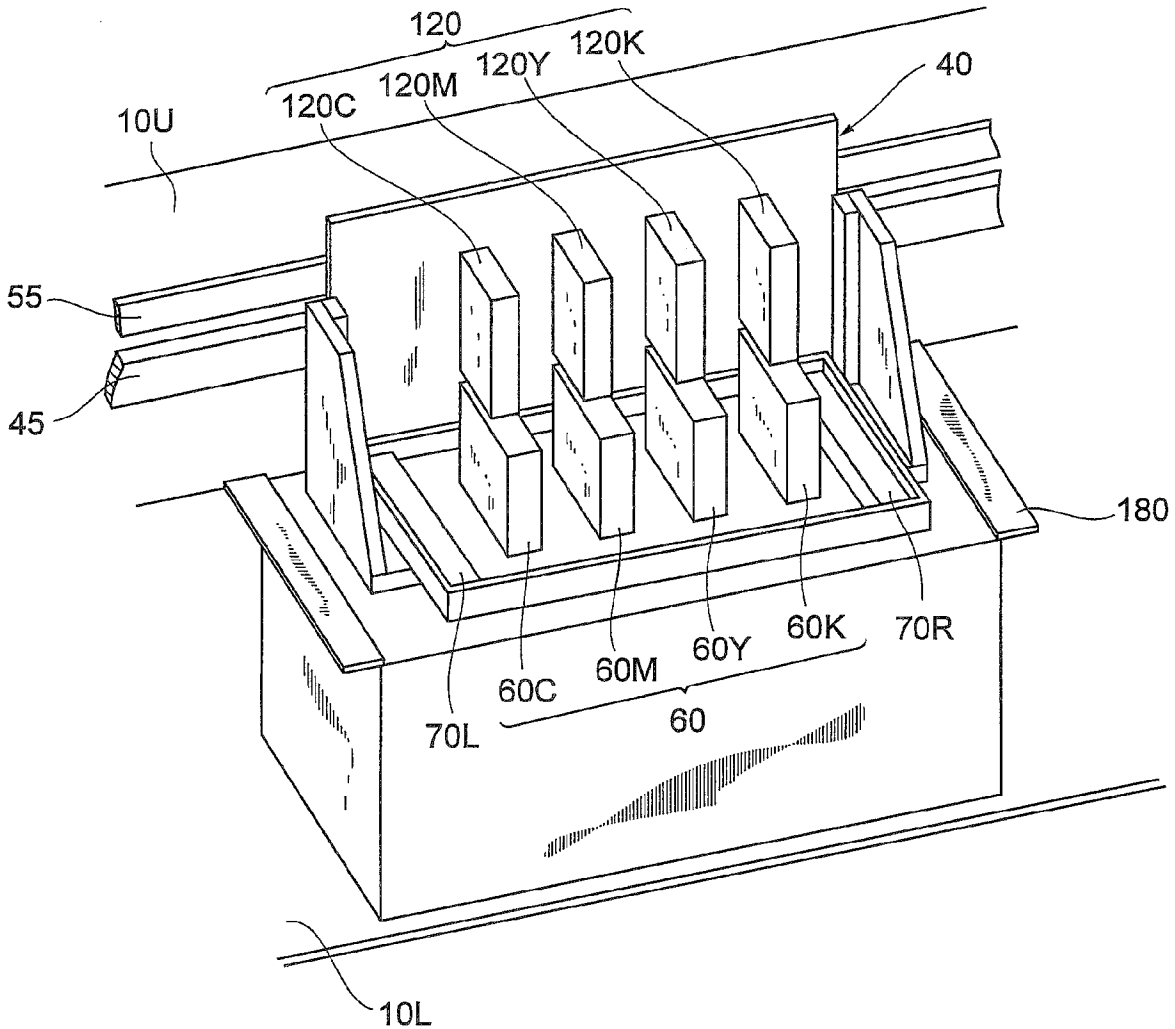
FIG. 5 is a perspective view of the periphery of a carriage of the printer apparatus.
Figure 6:
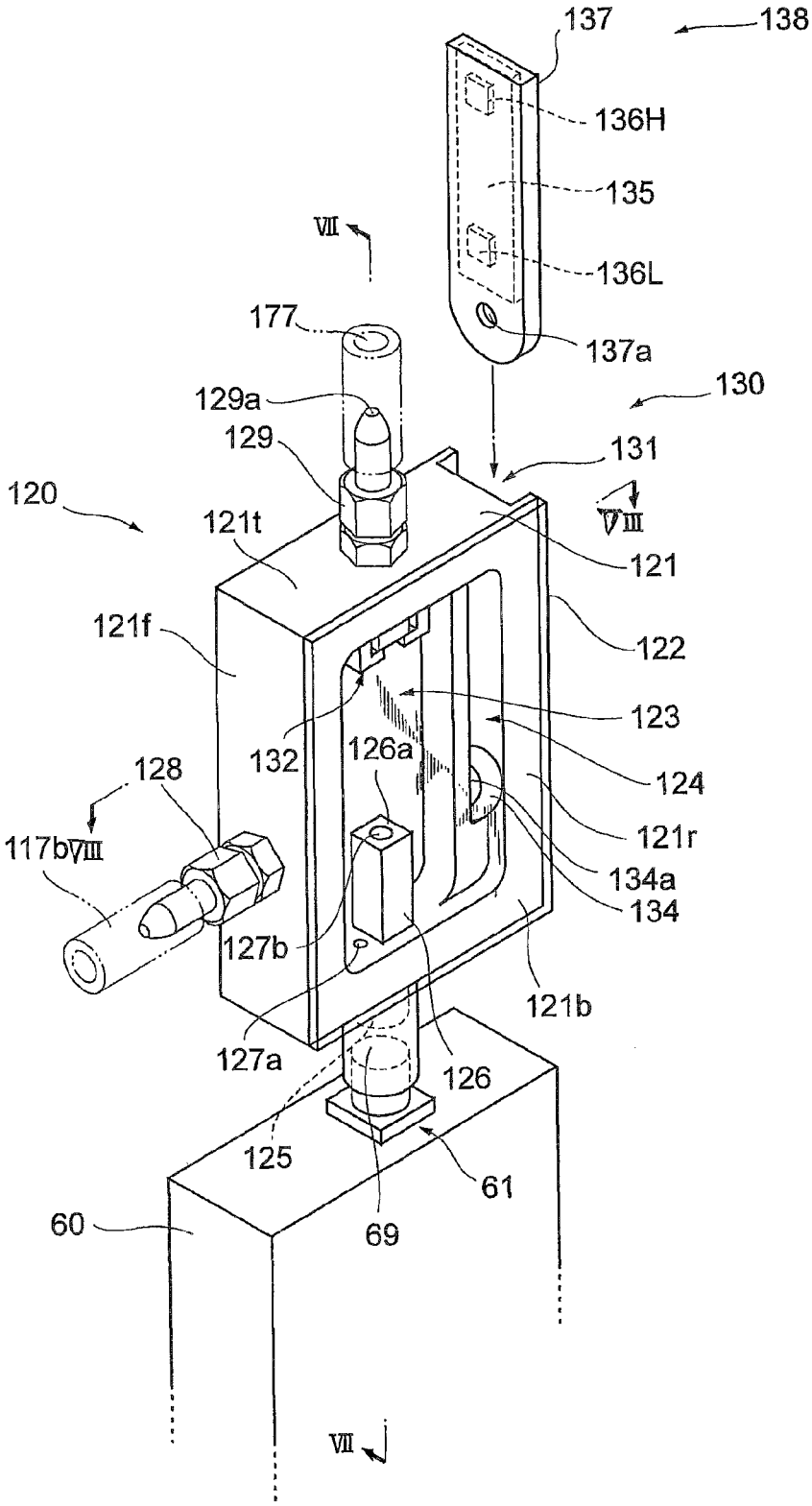
FIG. 6 is an external perspective view of a sub-tank disposed on the carriage.
Figure 7:
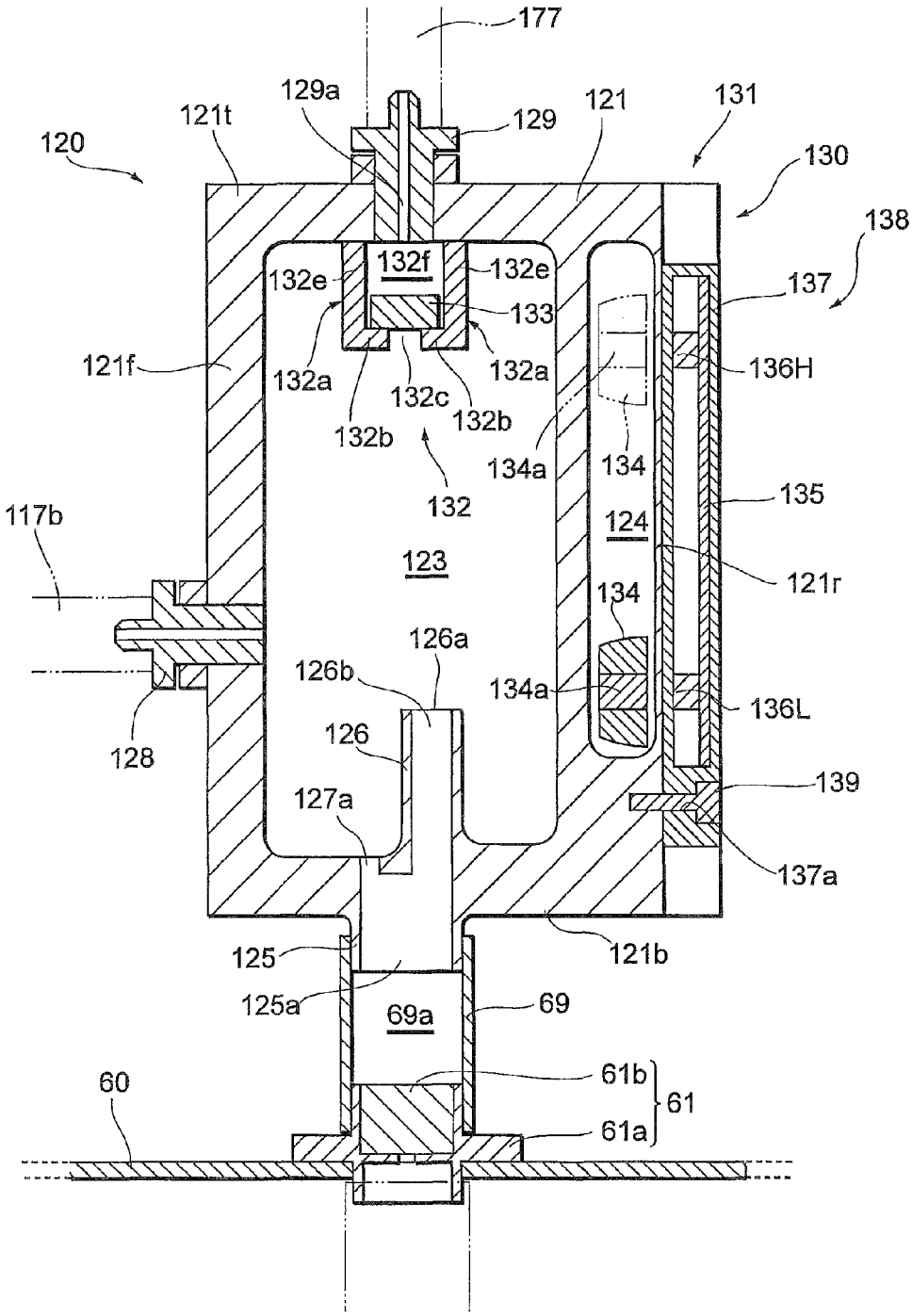
FIG. 7 is a sectional view taken along a line VII-VII in FIG. 6.

Generally, the print head 60 includes print head(s) of which number corresponds to the number of inks used in the printer apparatus P and which are aligned in the lateral direction. For example, in case of a printer apparatus using UV inks of four basic colors, i.e. cyan (C), magenta (M), yellow (Y), and black (K) and having ink cartridges corresponding to the respective colors, four print heads 60 (a first print head 60C, a second print head 60M, a third print head 60Y, and a fourth print head 60K) corresponding to the respective ink cartridges are provided as shown in a perspective view of the periphery of the carriage in FIG. 5. In the carriage 40, sub-tanks 120 (a first sub-tank 120C, a second sub-tank 120M, a third sub-tank 120Y, and a fourth sub-tank 120K) of the ink supply device 100 as will be described in detail later are provided to correspond to the print heads 60C, 60M, 60Y, and 60K, respectively. As shown in FIG. 6 and FIG. 7, a filter assembly 61 including a filter 61*b* and a filter holding member 61*a* for holding the filter 61*b* is attached to the upper surface of the print head 60. The filter 61*b* is a member for filtering the UV ink sent from the sub-tank 120. The UV ink filtered by the filter 61*b* is sent to the ink chamber of the print head 60. The method for driving the print head 60 (the method of ejecting ink fine particles) may be the thermal method or the piezo method.

On the left and right sides of the carriage 40, UV light sources for irradiating the UV ink ejected from the print head 60 to the print medium M with ultraviolet lights to cure the UV ink are arranged. The UV light sources are a left UV light source 70L located on the left side of the carriage 40 and a right UV light source 70R located on the right side of the carriage 40 so that the first through fourth print heads 60C, 60M, 60Y, and 60K arranged in the carriage 40 are sandwiched from the left and right by the left and right UV light sources 70L, 70R. Each of the left UV light source 70L and the right UV light source 70R is a light source, for example a UV lamp or UV-LED, which emits ultraviolet light of which wavelength λ is in a range of from about 100 to 380 nm. The on-off actions of the left and right UV light sources 70L, 70R are controlled by the control unit 80 according to the movement of the carriage 40 by the carriage moving mechanism 50 and the ejection of the ink from the print head 60.

The carriage moving mechanism 50 includes a driving pulley 51 and a driven pulley 52 which are disposed in left and right portions of the frame 10 such that the guide rail 45 is arranged between the driving pulley 51 and the driven pulley 52, a carriage driving motor 53 for rotating the driving pulley 51, and an endless belt-like timing belt 55 wound around the driving pulley 51 and the driven pulley 52 with some tension. The carriage 40 is connected and fixed to the timing belt 55. By driving the carriage driving motor 53, the carriage 40 supported by the guide rail is moved above the platen 20 in the lateral direction for a distance according to a rotational angle of the carriage driving motor 53 (a drive controlled value outputted from the control unit 80).

The control unit 80 includes a ROM 81 in which a control program for controlling the actions of the respective components of the printer apparatus is written, a RAM 82 in which a print program for forming images on the print medium M and the like are temporarily stored, an arithmetic processing unit 83 which conducts arithmetic processing based on the print program read from the RAM 82 and operational signals inputted through an operational panel to control the actions of the respective components according to the control program, the operational panel 88 on which a display panel for displaying the operational state of the printer apparatus P and various operational switches are provided. The control unit 80 controls the anteroposterior movement of the print medium M by the medium moving mechanism 30, the lateral movement of the carriage 40 by the carriage moving mechanism 50, the supply of ink by the ink supply device 100, the ejection of ink from nozzles of the print head 60, and the like.

For example, in case of forming images on the print medium M based on the print program read from the control unit 80, the print medium M and the print head 60 are moved relative to each other by combination of the anteroposterior movement of the print medium M by the medium moving mechanism 30 and the lateral movement of the carriage 40 by the carriage moving mechanism 50. During this, ink is ejected onto the print medium M from the print head 60 and the UV light source, positioned behind the carriage 40 in the moving direction, (for example, the left UV light source 70L when the carriage is moved rightward) is turned on, thereby forming image of information according to the print program.

Figure 4:
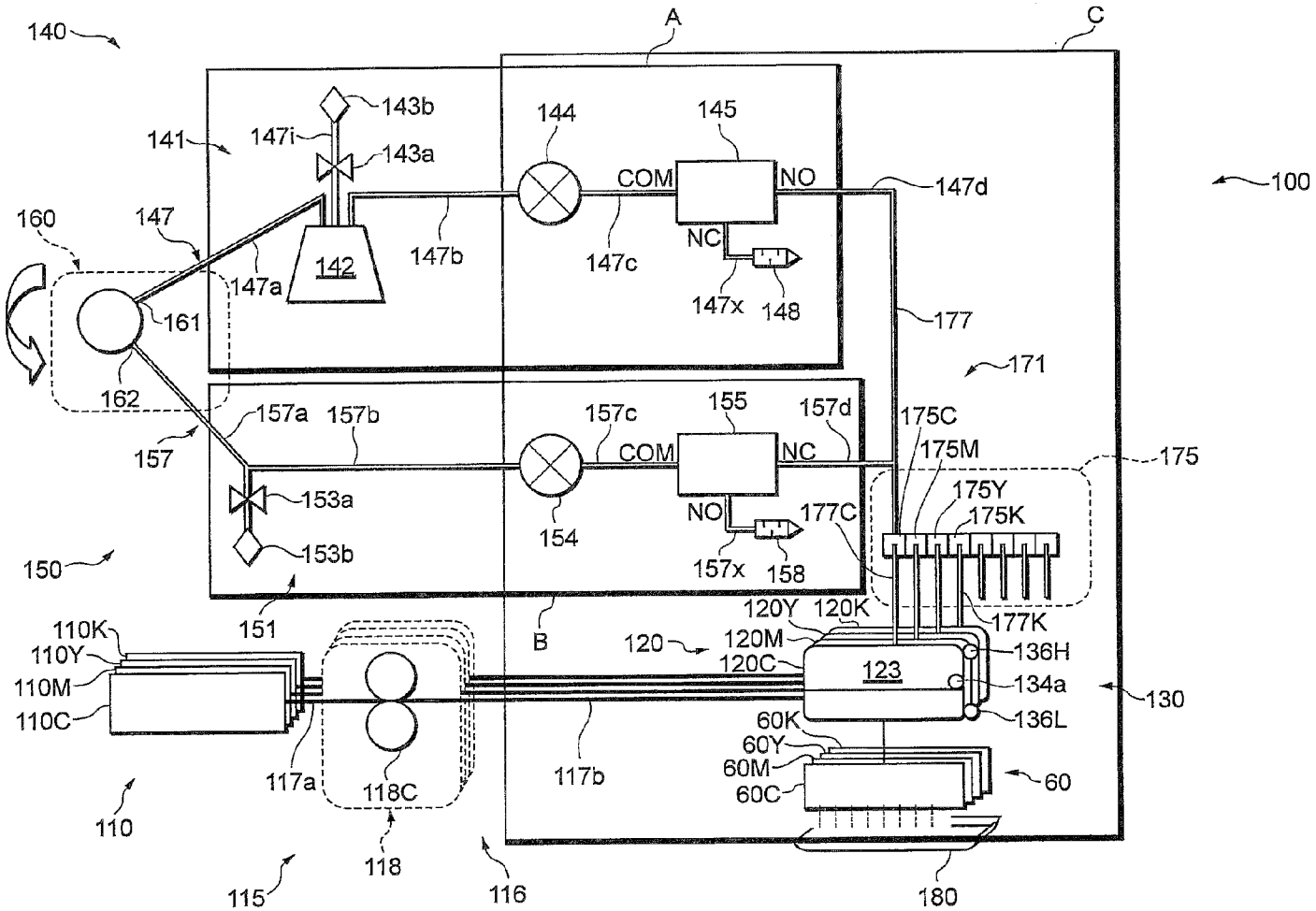
FIG. 4 is a system diagram of an ink supply device.
Figure 8:
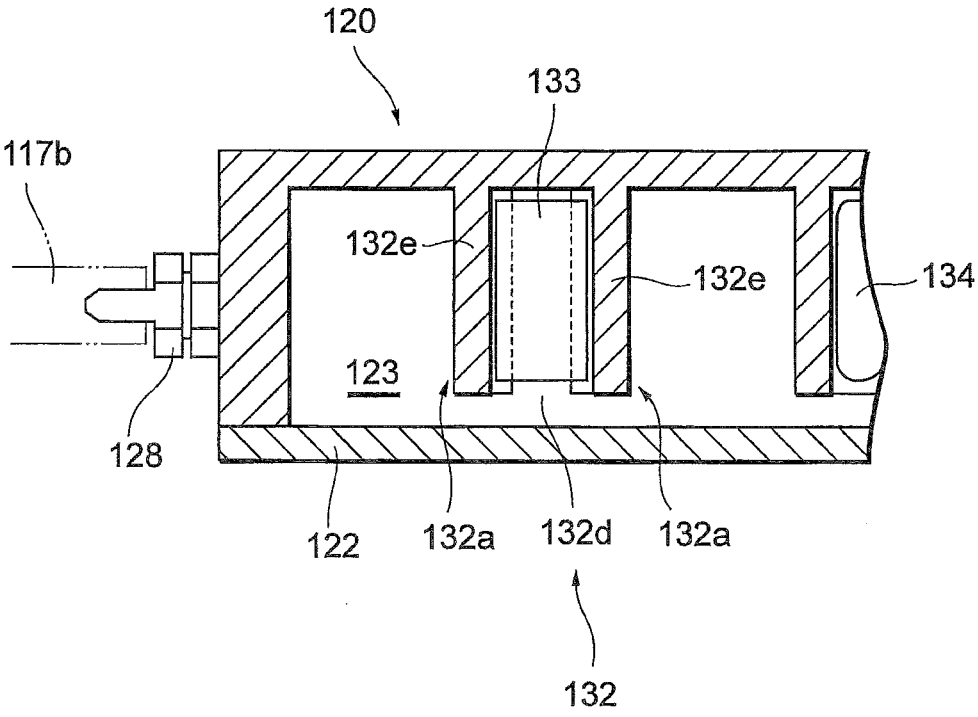
FIG. 8 is a sectional view taken along a line VIII-VIII in FIG. 6.
Figure 9:
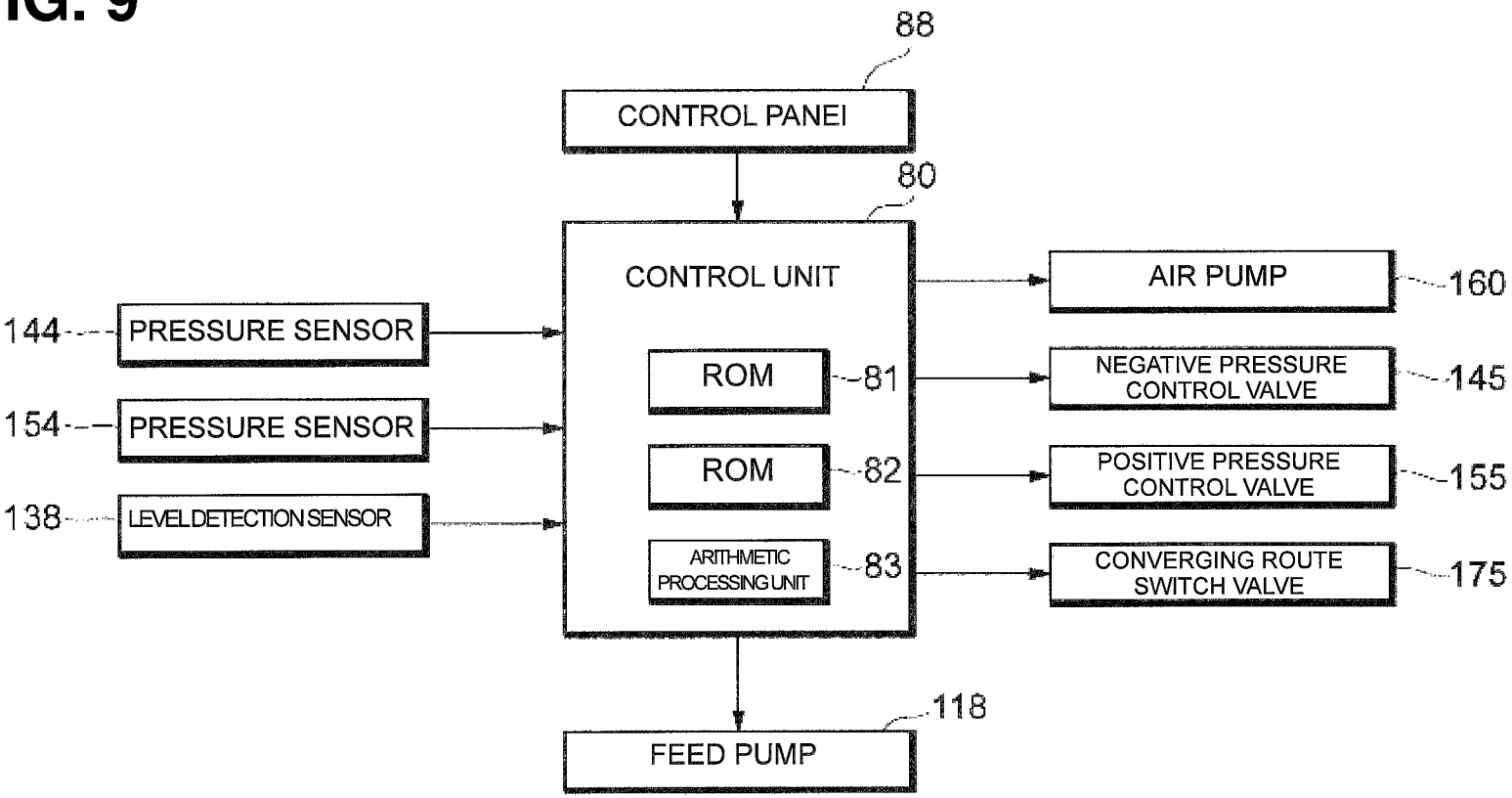
FIG. 9 is an outline block diagram of the ink supply device.

In the printer apparatus P having the structure outlined in the above, UV ink is supplied to the print head 60 disposed on the carriage 40 by the ink supply device 100. FIG. 4 is a system diagram of the ink supply device 100, FIG. 6 is a perspective external view of the sub-tank 120, FIG. 7 is a sectional view taken along a line VII-VII of FIG. 6, FIG. 8 is a sectional view taken along a line VIII-VIII of FIG. 6, and FIG. 9 is a schematic block diagram of the ink supply device 100.

The ink supply device 100 includes the sub-tank 120 connected to the print head 60, a main tank 110 which is connected to the sub-tank 120 and in which UV inks to be supplied to the sub-tank 120 are stored, a sub-tank depressurizing unit 140 for reducing the inner pressure of the sub-tank 120 to a negative pressure, a sub-tank pressurizing unit 150 for increasing the inner pressure of the sub-tank 120 to a positive pressure, an ink sending unit 115 for sending the UV inks stored in the main tank 110 to the sub-tank 120, and the like. The sub-tank depressurizing unit 140 and the sub-tank pressurizing unit 150 have a common single air pump 160.

The main tank 110 is designed to store the UV inks of volume corresponding to the consumption quantities per a unit period of time in the printer apparatus P. In this embodiment, corresponding to the aforementioned four colors C, M, Y, and K, cartridge type main tanks 110 (a first main tank 110C, a second main tank 110M, a third main tank 110Y, and a fourth main tank 110K) of about 500 ml for the respective colors are used. These main tanks 110 are detachably attached to the back surface of the apparatus body 1 (see FIG. 2). According to this structure, the main tank 110 which is relatively large can be placed at an arbitrary position within the range of the pump head of a feed pump 118 as will be described later, thereby enabling the size reduction of the printer P. In addition, by disposing the main tank 110 at a position where the operator can reach easily, the operation of replacing the main tanks 110 is facilitated. The form of the main tanks 110 may be another form such as a cylindrical vessel or a flexible envelope. The installation position of the ink tanks may be suitably set at the front face or the top of the apparatus body 1, or a position separate from the apparatus body 1.

As shown in FIG. 6, the sub-tank 120 includes a reservoir member 121 having a thin box-like shape which opens to one side (the right) and is long in the vertical direction as seen in a side view, and a lid member 122 for covering and closing an opening of the reservoir member 121. Inside a tank which is formed by closing with the lid member 122, an ink storage chamber 123 for storing UV ink is formed. In addition, a float receiving portion 124 is formed which communicates with the ink storage chamber 123 and which is a groove-like portion extending vertically on the rear side of the ink storage chamber 123. Inside the float receiving portion 124, a disc-like float 134, which has a magnet 134*a* fixed to the center thereof and floats on the UV ink, is accommodated in the float receiving portion 124 to freely move in the vertical direction. In this embodiment, if UV ink having, for example, a specific gravity of about 1.0 is used, it is preferable that the float 134 has, for example, a specific gravity of about 0.25 so as to float on the UV ink.

Of the sub-tank 120, the lid member 122 is integrally attached to the reservoir member 121 by applying sealant or adhesive on the peripheries of the opening of the reservoir member 121 and is strongly connected by fastening means such as screws (not shown) so that the ink storage chamber 123 is held in the sealed state. At least one of the lid member 122 and the reservoir member 121 is made of a transparent or semi-transparent material and is so configured that the storing state of UV ink in the ink storage chamber 123 and the floating state of the float 134 on the UV ink can be observed from the outside. As to the lid member 122, a transparent film may be used, for instance. In this case, the transparent film is welded to the reservoir member 121 so as to keep the ink storage chamber 123 in the sealed state.

Formed on the bottom side of the sub-tank 120 is a short cylindrical connector portion 125 projecting downwardly from a bottom wall 121*b* of the reservoir member 121. Formed in the connector portion 125 is a connector space 125*a* opening downward. Above the connector portion 125, a block-like duct portion 126 is formed to extend from the bottom wall 121*b* into the inside of the ink storage chamber 123 upwardly. A first introduction passage 127*a* is formed to penetrate vertically the bottom wall 121*b* to connect the bottom of the ink storage chamber 123 and the connector space 125*a* and a second introduction passage 126*b* is formed to penetrate vertically the duct portion 126 and the bottom wall 121*b* to connect the top 126*a* of the duct portion 126 and the connector space 125*a*. In addition, the connector portion 125 and the filter assembly 61 are connected to each other by a tube 69 in which a tube space 69*a* is formed. Therefore, the ink storage chamber 123 of the sub-tank 120 and the ink chamber of the print head 60 are connected to each other via the first introduction passage 127*a*, the second introduction passage 126*b*, the connector space 125*a* and the tube space 69*a*. It should be noted that the sectional area of the first introduction passage 127*a* is smaller than the sectional area of the second introduction passage 126*b*. A bat-like ink tray 180 for receiving UV ink is placed below the print head 60 (60C, 60M, 60Y, and 60K) in a state that the carriage 40 is set at the reference position (so-called "home position") when the printer apparatus does not work (see FIG. 5).

On the rear surface of the sub-tank 120, a sub-tank reserve detecting unit 130 for detecting the reserved state of the UV ink in the ink storage chamber 123 is provided. The sub-tank reserve detecting unit 130 includes the float 134 which is accommodated in a float receiving portion 124 extending in the vertical direction in a way that the float 134 can freely move in the vertical direction and which moves in the vertical direction according to the surface of the UV ink in the ink storage chamber 123 and a level detection sensor 138 which detects the level of the UV ink by detecting magnetism of the magnet 134*a* fixed to the float 134. The level detection sensor 138 is so configured that a casing member 137 accommodates a level detection plate 135 to which a Hi detection sensor 136H and a Lo detection sensor 136L capable of detecting the magnetism of the magnet 134*a* are attached. It should be noted that each of the Hi detection sensor 136H and the Lo detection sensor 136L may be composed of, for example, a Faraday element, a magneto-impedance element, or the like and is preferably composed of a Hall element. Also, a sensor capable of detecting both poles of the magnet may be used. As for the magnet 134*a*, any of various magnets may be used and an anisotropic ferrite magnet is preferably used.

Formed in a rear wall 121*r* of the reservoir member 121 is a sensor receiving portion 131 which has a groove-like shape extending in the vertical direction, and into which the level detection sensor 138 is inserted. As shown in FIG. 7, by inserting and fastening a mounting screw 139 into a mounting hole 137*a* of the casing member 137, the level detection sensor 138 is fixed to the rear wall 121*r*. In the state that the level detection sensor 138 is fixed, the Hi detection sensor 136H has a function capable of detecting the level of the UV ink in the ink storage chamber 123 reaching the upper limit position. On the other hand, the Lo detection sensor 136L has a function capable of detecting the level of the UV ink in the storage chamber 123 reaching the lower limit position.

As shown in FIG. 7, the level detection sensor 138 is disposed to face the float 134 with the rear wall 121*r* between them. The magnetism of the magnet 134*a* fixed to the float 134 is detected by the Hi detection sensor 136H or the Lo detection sensor 136L, and thereby the vertical position of the float 134 is detected, that is, the level of the UV ink retained in the ink storage chamber 123 is detected. As can be seen from FIG. 7, the inner wall of the float receiving portion 124 and the anteroposterior surfaces of the float 134 (the magnet 134*a*) are proximally positioned, whereby the float 134 moves substantially straight in the vertical direction in the float receiving portion 124 according to the level of the UV ink. According to this structure, the level of the UV ink in the ink storage chamber 123 is detected by the level detection sensor 138 and the detected result is outputted to the control unit 80.

On the front side of the sub-tank 120, as can be seen from FIG. 7, an ink introduction passage is formed at a middle position in the vertical direction to penetrate the front wall 121*f* of the reservoir member 121 in the anteroposterior direction and a tube connector 128 is connected to the ink introduction passage. On the upper side of the sub-tank 120, an air introduction passage is formed to penetrate the top wall 121*t* of the reservoir member 121 in the vertical direction and a tube connector 129 with an air introduction hole 129*a* formed in the center thereof is connected to the air introduction passage.

As shown in FIG. 7, in the ink storage chamber 123 below the tube connector 129, a backflow prevention portion 132 is formed. The backflow prevention portion 132 mainly includes float supporting members 132*a* and a sealing float 133. The float supporting members 132*a* are paired as front and rear members each of which has a vertical portion 132*e* extending from the lower surface of the top wall 121*t* downwardly and an engaging rib 132*b* which is formed by bending in the anteroposterior direction an end portion of the vertical portion 132*e*. The engaging ribs 132*b* and 132*b* are spaced apart from each other in the anteroposterior direction by a rib space 132*c* and the float supporting members 132*a* have a lateral space 132*d* from the lid member 122 as shown in FIG. 8. The sealing float 133 is accommodated in a sealing float receiving portion 132*f*, which is surrounded by the paired float supporting members 132*a* to extend in the vertical direction, such that the sealing float 133 freely moves in the vertical direction. The sealing float 133 is designed to have such a size as to come in contact with a lower opening of the air introduction hole 129*a* to seal the air introduction hole 129*a* when the sealing float 133 rises as high as the uppermost position in the sealing float receiving portion 132*f*. The pressure control of the ink storage chamber 123 by the sub-tank depressurizing unit 140 as will be described later is conducted by sucking air in the ink storage chamber 123 mainly through the lateral space 132*d* into the air introduction hole 129*a*. The pressure control of the ink storage chamber 123 by the sub-tank pressurizing unit 150 as will be described later is conducted by flowing air from the air introduction hole 129*a* mainly through the lateral space 132*d* into the ink storage chamber 123. The sealing float 133 is preferably a float of which specific gravity is, for example, about 0.25.

The ink sending unit 115 is composed of a main supply route 116 connecting the main tank 110 and the sub-tank 120. The main supply route 116 includes an ink suction line 117*a* connected to the main tank 110 and a feed pump 118, an ink delivery line 117*b* connected to a feed pump 118 and the tube connector 128, a feed pump 118 which is disposed in the apparatus body 1 to supply the UV ink stored in the main tank 110 to the sub-tank 120, and the like. The feed pump 118 is a pump capable of forcing the UV ink to be sent into the sub-tank 120 even in a state that the ink suction line 117*a* is not filled with the UV ink, that is, the UV ink is mixed with air. For example, a tube pump or a diaphragm pump may be preferably used as the feed pump 118.

The sub-tank depressurizing unit 140 is composed of a negative pressure route 141 connecting the sub-tank 120 and an inlet 161 of the air pump 160. The negative pressure route 141 includes an air chamber 142 composed of a sealed vessel, a pressure sensor 144 for detecting pressure of the negative pressure route 141, a negative pressure control valve 145 for opening and closing the negative pressure route 141, lines 147 (147*a*, 147*b*, 147*c*, 147*d*) composed of tubes connecting these components to connect the inlet 161 of the air pump and the sub-tank 120 and the like, the main components being shown and surrounded by a frame A in FIG. 4. It should be noted that components surrounded by the frame C in FIG. 4 are disposed in the carriage 40 and components outside of the frame C are disposed in the apparatus body 1.

The air chamber 142 is connected to the inlet 161 of the air pump 160 so that air in the chamber is discharged by the action of the air pump 160 so as to reduce the pressure of the air chamber into a negative pressure state. The air chamber 142 is provided with an air introduction line 147*i* for introducing air into the chamber of which pressure is reduced into a negative pressure. The air introduction line 147*i* has a flow regulating valve 143*a* for adjusting the flow rate of air and an air filter 143*b* for dust removal. In a state that the air pump 160 and the sub-tank 120 are connected via the negative pressure route 141, the flow regulating valve 143*a* keeps the inner pressure of the air chamber 142 constant by adjusting the flow rate of air entering into the air chamber 142. Therefore, the inner pressure of the ink storage chamber 123 is set to be a predetermined value (for example, −1.2 kPa: hereinafter referred to as "preset negative pressure") in a range of from about −1 to −2 kPa which is suitable for meniscus formation at the nozzle portion.

The negative pressure control valve 145 is an electromagnetic valve for switching the line 147*c* and the line 147*d* between the connected state and the disconnected state and which is positioned between the air chamber 142 and the sub-tank 120 and is disposed in the carriage 40. In this embodiment, a three-way valve is employed as the negative pressure control valve 145 so that the line 147*c* is connected to a common port (COM) of the negative pressure control valve 145, the line 147*d* is connected to a normal open port (NO) of the negative pressure control valve 145, and a normal closed port (NC) of the negative pressure control valve 145 is opened to atmosphere via a line 147*x* and a muffler 148.

Therefore, when the negative pressure control valve 145 is in the OFF state (during normal operation such as printing or waiting, and during ink replenishment), the line 147*c* and the line 147*d* are connected so as to set the negative pressure route 141 in the communicating state so that the inlet 161 and the sub-tank 120 are connected via a converging route 171 as will be described later. On the other hand, when the negative pressure control valve 145 is in the ON state (such as during the initial ink filling or cleaning), the line 147*c* and the line 147*d* are disconnected so that the negative pressure route 141 is shut off and, at the same time, the line 147*c* is connected to the line 147*x* so as to open a route on the inlet side of the air pump 160 to the atmosphere. The negative pressure control valve 145 is connected to the control unit 80 so that the ON/OFF of the negative pressure control valve 145 is controlled by the control unit 80. Such a configuration is preferred for the ON/OFF control that during ink replenishment the negative pressure control valve 145 is set in the OFF state only for a period of time predetermined based on experiment results before the negative pressure control valve 145 is set ON so as to prevent the backflow of ink to the side of the negative pressure control valve 145.

The pressure sensor 144 is a pressure sensor of a gauge pressure type which has a detection range about ±5 kPa and is disposed between the air chamber 142 and the negative pressure control valve 145. The pressure sensor 144 detects the pressure of the line 147 near the sub-tank. The detection signal of the pressure sensor 144 is inputted into the control unit 80.

The sub-tank pressurizing unit 150 is composed of a positive pressure route 151 connecting the sub-tank 120 and an outlet 162 of the air pump 160. The positive pressure route 151 includes a flow regulating valve 153*a* for adjusting the flow rate of air, an air filter 153*b* for dust removal, a pressure sensor 154 for detecting the pressure of the positive pressure route 151, a positive pressure control valve 155 for opening and closing the positive pressure route 151, lines 157 (157*a*, 157*b*, 157*c*, 157*d*) composed of tubes connecting these components to connect the outlet 162 of the air pump 160 and the sub-tank 120 and the like, the main components being shown and surrounded by a frame B in FIG. 4. The flow regulating valve 153*a* prevents the inner pressure of the ink storage chamber 123 from rising to a value exceeding a predetermined value by adjusting the flow rate of air flowing through the positive pressure route 151 in a state that the air pump 160 and the sub-tank 120 are connected by the positive pressure route.

The positive pressure control valve 155 is an electromagnetic valve for switching the line 157*c* and the line 157*d* between the connected state and the disconnected state and which is positioned between the flow regulating valve 153*a* and the sub-tank 120 and is disposed in the carriage 40. In this embodiment, a three-way valve is employed as the positive pressure control valve 155 so that the line 157*c* is connected to a common port (COM) of the positive pressure control valve 155, the line 157*d* is connected to a normal closed port (NC) of the positive pressure control valve 155, and a normal open port (NO) of the positive pressure control valve 155 is opened to atmosphere via a line 157*x* and a silencer 158.

Therefore, when the positive pressure control valve 155 is in the OFF state (during normal operation such as printing or waiting, or during ink replenishment), the line 157*c* and the line 157*d* are disconnected so that the positive pressure route 151 is shut off and, at the same time, the line 157*c* is connected to the line 157*x* so as to open the positive pressure route on the outlet side of the air pump 160 to the atmosphere. On the other hand, when the positive pressure control valve 155 is in the ON state (such as during the initial ink filling or cleaning), the line 157*c* and the line 157*d* are connected so as to set the positive pressure route 151 in the communicating state so that the outlet 162 and the sub-tank 120 are connected via the converging route 171. The positive pressure control valve 155 is connected to the control unit 80 so that the ON/OFF of the positive pressure control valve 155 is controlled by the control unit 80.

The pressure sensor 154 is a pressure sensor of a gauge pressure type which has a detection range about ±50 kPa and is disposed in the carriage 40. The pressure sensor 154 detects the pressure of the line 157 near the sub-tank. The detection signal of the pressure sensor 154 is inputted into the control unit 80.

The air pump 160 is a pump which sucks air from the negative pressure route 141 connected to the inlet 161, and discharges the sucked air into the positive pressure route 151 connected to the outlet 162 and which is thus in a form of producing a predetermined positive pressure and a predetermined negative pressure at the outlet 162 and the inlet 161, respectively. For example, a diaphragm pump capable of producing positive and negative pressures of about ±40 kPa is preferably employed.

The negative pressure route 141 and the positive pressure route 151 converge on the way to the sub-tank 120 so that the converging route 171 is formed. The converging route 171 includes a line 177 which is connected to the sub-tank and on which the line 147*d* and the line 157*d* are converged and a converging route switch valve 175 for opening and closing the converging route 171. The converting route switch valves 175 are provided to correspond to the sub-tanks 120, respectively. In this embodiment, the converging route 171 (the line 177) is branched into four routes at the converging route switch valve 175 so that the converging route switch valve 175 is designed to open and close the branched converging routes (lines 177C, 177M, 177Y, and 177K, numerals of some of which are omitted), respectively. The operation of the converging route switch valve 175 is controlled by the control unit 80.

In the ink supply device 100 having the aforementioned structure, the operations of the feed pump 118, the negative pressure control valve 145, the positive pressure control valve 155, and the air pump 160 are controlled by the control unit 80 in the following manner. As apparent from the aforementioned description, the four systems (C, M, Y, and K) as systems for supplying UV inks have the same structures so that common components of the respective systems will not be described.

(Control During Normal Operation)

As the main electric power source for the printer apparatus P is turned ON, the control unit 80 reads out the control program stored in the ROM 81 and controls the operation of respective components of the printer apparatus according to the read control program. In the ink supply device 100, electric power is supplied to the air pump 160 to set the air pump 160 to the rotational driven state and all of the converging route switch valves 175 are turned on. At this point, it is preferable to turn on all of the converging route switch valves 175 after keeping the inner pressure of the sub-tanks to be negative (that is, the negative pressure control valve 145 and the positive pressure control valve 155 are both in the OFF state). After turning on the converging route switch valves 175, the negative pressure control valve 145 and the positive pressure control valve 155 are still in the OFF state. Therefore, in the negative pressure route 141, the communication between the line 147*c* and the line 147*d* is allowed so as to connect the inlet 161 and the ink storage chamber 123. In the positive pressure route 151, the line 157*c* and the line 157*x* are connected so as to open the route on the outlet side of the air pump 160 to atmosphere. Accordingly, air in the line 147 connected to the inlet 161 is sucked to reduce the inner pressure of the air chamber 142 to a negative pressure so that the inner pressure of the air chamber 142 is stabilized at a substantially constant value defined according to the balance between the flow rate of entering air adjusted by the flow regulating valve 143*a* and the amount of air sucked by the air pump 160. It should be noted that the inner pressures of the ink storage chambers 123 of the four sub-tanks are all held stably in the same preset negative pressure. As the printer apparatus P is activated in this manner, after that, the air pump 160 is kept running so that the inner pressure of the sub-tank 120 is always held at the preset negative pressure during execution of the print program, regardless of whenever the printing is in progress or waiting.

In operation, normally, some degree of UV ink is stored in the ink storage chamber 123 of the sub-tank 120. As for the amount of stored UV ink, the magnetism of the magnet 134*a* fixed to the float 134 which moves in the vertical direction together with the surface of the UV ink is detected by the Hi detection sensor 136H, thereby detecting that the level of the UV ink in the ink storage chamber 123 reaches the upper limit. On the other hand, the magnetism of the magnet 134*a* is detected by the Lo detection sensor 136L, thereby detecting that the level of the UV ink in the ink storage chamber 123 reaches the lower limit. By the aforementioned structure in which the magnetism of the magnet 134*a* is detected by the magnetic sensors 136 so as to detect the level of the ink, it is possible to precisely detect the level of the ink without being affected by color of the UV ink, as compared to another detecting method, for example, depending on whether a detection light transmits or not.

In accordance with the start of the print program or the like, the UV ink retained in the ink storage chamber 123 is ejected from the nozzles of the print head 60 and is thus consumed so that the UV ink retained is gradually reduced. When the amount of the UV ink retained in the ink storage chamber 123 becomes a predetermined amount or less, the UV ink stored in the main tank 110 is supplied to the sub-tank 120 by the ink sending unit 115, thereby refilling the sub-tank 120 with the UV ink.

Specifically, as the UV ink retained in the ink storage chamber 123 is reduced, the level of the UV ink is lowered so that the float 134 is also moved downwardly in the float receiving portion 124 according to the level of the UV ink. When the residual amount of the UV ink becomes a predetermined value or less, the magnetism of the magnet 134*a* fixed to the float 134 is detected by the Lo detection sensor 136L which is located at the lower most position. The control unit 80 receives the detection signal from the level detection sensor 138 and actuates the feed pump 118 in a state that the inner pressure of the ink storage chamber 123 is reduced to be a negative pressure. The UV ink sent from the main tank 110 by the feed pump 18 is supplied to the ink storage chamber 123 through the line 117*b* and the tube connector 128 so as to increase the amount of the ink stored in the ink storage chamber 123. According to the increase in amount of the stored ink, the level of the UV ink raises, and the float 134 moves upwardly in the float receiving portion 124 according to the level of the ink. When the magnetism of the magnet 134*a* fixed to the float 134 is detected by the Hi detection sensor 136H which is located at the upper most position, the feed pump 118 is stopped, thereby completing the replenishment of the UV ink to the ink storage chamber 123.

The following description will be made assuming that the float 134 and the magnet 134*a* are stuck at a level below the predetermined value and do not move in the vertical direction of the float receiving portion 124 due to any reason. In this case, since the control unit 80 keeps the feed pump 118 driven until the magnetism of the magnet 134*a* is detected by the Hi detection sensor 136H, the UV ink is continuously supplied even after the level of the UV ink reaches the filling reference level. At this point, the UV ink entering into the sealing float receiving portion 132*f* moves the sealing float 133 upwardly. Then, the upper surface of the sealing float 133 comes in contact with the opening at the lower end of the air introduction hole 129*a* so that the sealing float 133 seals the air introduction hole 129*a* before the UV ink enters into the air introduction hole 129*a*. Therefore, even if such a situation that the normal detection of the level of the UV ink by the magnet 134*a* is impossible is brought, it is possible to prevent the UV ink from flowing into the air introduction hole 129*a*.

(Control During the Initial Ink Filling)

Figure 10:
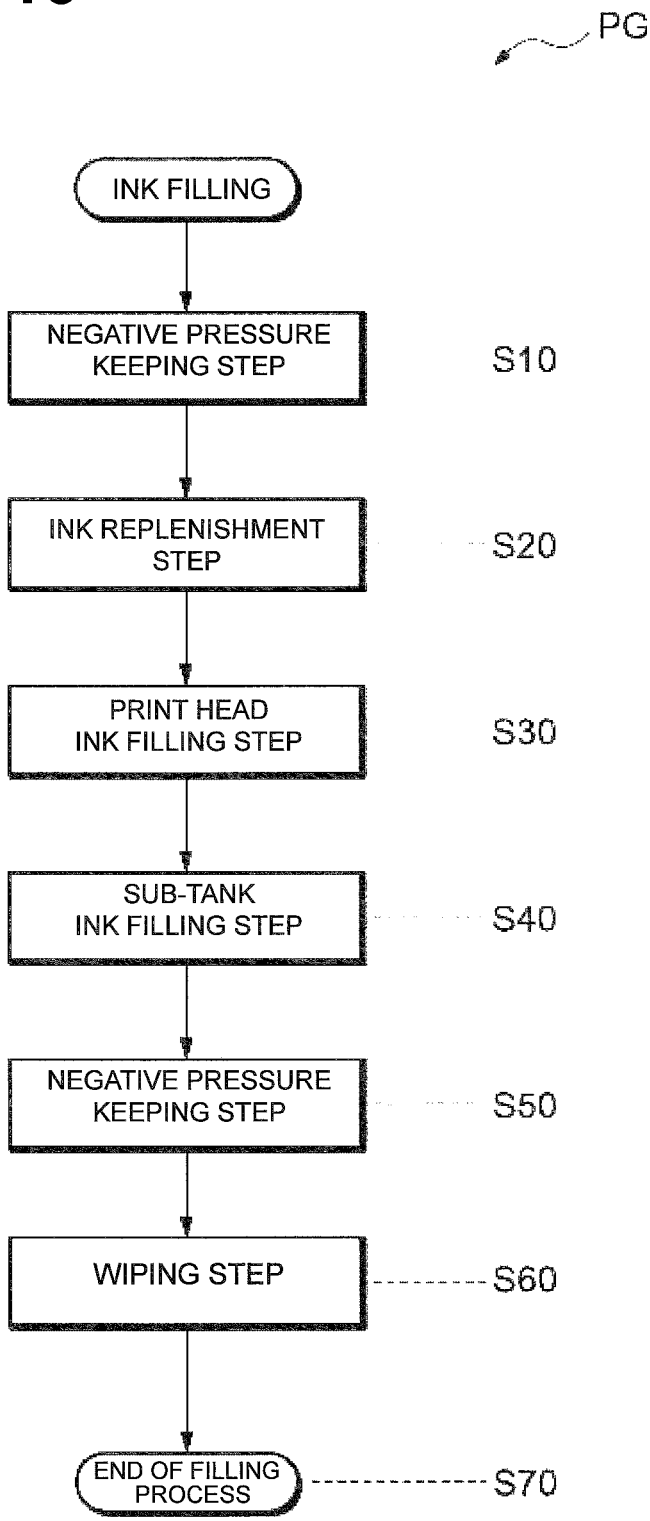
FIG. 10 is a flow chart of an ink filling program.

At the time of the initial filling of UV ink or the start up after nozzle cleaning with cleaning liquid, there is a case that any UV ink does not exist in the ink chamber of the print head 60, the sub-tank 120, and the line 117 of the main supply route. In such a case, according to the ink filling command inputted from the operational panel 88 into the control unit 80, the control for the initial ink filling is carried out as follows. FIG. 10 is a flow chart of the ink filling program PG stored in the ROM 81 for the ink filling control.

As a command for carrying out the ink filling is inputted into the control unit 80 by pushing a function key or the like of the operational panel 88 to select an "ink filling" process and specify one or more of the print heads 60, the arithmetic processing unit 83 according to the ink filling program carries out a process of turning ON the converging route switch valve(s) corresponding to the print head(s), of which ink filling is required, and turning OFF the other converging route switch valve(s) in the state the inner pressure of the sub-tank is kept to be a negative pressure (that is, the negative pressure control valve 145 and the positive pressure control valve 155 are both in the OFF state) at step S10 (negative pressure keeping step). Then, the process proceeds to step S20. For example, in case that only the first print head 60C is selected as the print head, of which the ink filling is required, by the operational panel 88, only the first converging route switch valve 175C corresponding to the first print head 60C is turned ON and the second through fourth converging route switch valves 175M, 175Y, 175K corresponding to the second through fourth print heads are turned OFF (hereinafter, description will be made with reference to this case).

In step S20 (ink replenishment step), the UV ink is sent from the first main tank 110C to the first sub-tank 120C of which inner pressure is reduced, thereby filling the first sub-tank 120C with the ink. That is, only the feed pump 118C corresponding to the first sub-tank 120C is actuated, whereby the UV ink stored in the first main tank 110C is supplied to the first sub-tank 120C. During this, the UV ink is supplied slowly through the tube connector 128. Therefore, the UV ink supplied to the first sub-tank 120C is introduced to the filter 61*b* by flowing through the first introduction passage 127*a* of which the opening is formed at the lower level and flowing downwardly along the peripheral walls of the connector space 125*a* and the tube space 69*a*. During this, air bubbles existing in the connector space 125*a*, the tube space 69*a*, and the filter 61*b* are removed while being introduced from the second introduction passage 126*b* to the ink storage chamber 123 and, in addition, the areas in the connector space 125*a*, the tube space 69*a*, and the filter 61*b* are filled with the UV ink. That is, the first introduction passage 127*a* of which the opening is formed at the lower level is used for introducing the UV ink and the second introduction passage 126*b* of which opening is formed at the higher level is used for eliminating air bubbles, thereby enabling the UV ink to be flowed through the passage from the ink storage chamber 123 to the filter 61*b* in the state that air bubbles are completely eliminated. After the passage from the ink storage chamber 123 to the filter 61*b* is filled with the UV ink, the feed pump 118C is stopped when the magnetism of the magnet 134*a* fixed to the float 134 is detected by the Hi detection sensor 136H disposed at the filling reference height, thereby storing an enough amount of the UV ink in the ink storage chamber 123 of the first sub-tank 120C.

Then, at step S30 (print head ink filling step), the negative pressure route 141 is shut off and the inner pressure of the first sub-tank 120C is increased into a positive pressure by the sub-tank pressurizing unit 150, thereby dropping a part of the UV ink stored into the first sub-tank 120C from the first print head 60C. Specifically, the control unit 80 turns on the negative pressure control valve 145 to shut off the communication between the line 147*c* and the line 147*d* and connect the line 147*c* to the line 147*x* so as to open the route on the inlet side of the air pump 160 to the atmosphere. In addition, the positive pressure control valve 155 is turned on to allow the communication between the line 157*c* and the line 157*d* so as to connect the outlet 162 of the air pump and the ink storage chamber 123 of the first sub-tank 120C. By this switch control, the air pump 160 and the first sub-tank 120C are connected via the positive pressure route 151 so that air discharged from the outlet 162 of the air pump 160 is supplied to the ink storage chamber 123 of the first sub-tank 120C. As a result, the UV ink stored in the ink storage chamber 123 of the first sub-tank 120C is forced through the first introduction passage 127*a* in a lower portion of the tank and the second introduction passage 126*b* and is filtered by the filter 61*b*. After that the UV ink is supplied to the nozzles of the first print head 60C. Then, the UV ink dropping from the nozzles of the first print head 60C is received by the ink tray 180.

At the step S30, the area from the ink storage chamber 123 of the first sub-tank 120C to the nozzles of the first print head 60C is filled with the UV ink. At this point, the air bubbles in the passage from the filter 61*b* to the nozzles of the first print head 60C are forced out through the nozzles so that the area from the first sub-tank 120C to the nozzles of the first print head 60C is filled with the UV ink. Then, the process proceeds to the next step S40. At this point, the converging route switch valves 175 other than the first converging route switch valve 175C are in the closed state so that the inner pressures of the second through fourth sub-tanks are held in the initial negative pressure.

At step S40 (sub-tank ink filling step), the positive pressure route 151 is shut off and the inner pressure of the first sub-tank 120C is reduced to a negative pressure by the sub-tank depressurizing unit 140. The ink is sent from the first main tank 110C into the first sub-tank 120C with the reduced pressure by the ink sending unit 115, thereby filling the first sub-tank 120C with the UV ink. That is, the control unit 80 turns off the positive pressure control valve 155 to shut off the communication between the line 157*c* and the line 157*d* and connects the line 157*c* to the line 157*x* so as to open the route on the outlet side of the air pump 160 to the atmosphere. In addition, the negative pressure control valve 145 is turned off to allow the communication between the line 147*c* and the line 147*d* and connect the inlet 161 of the air pump 160 to the ink storage chamber 123 of the first sub-tank 120C.

By this switch control, in the negative pressure route 141 the air pump 160 and the first sub-tank 120C are connected so that air in the ink storage chamber 123 of the first sub-tank is sucked by the air pump 160. Accordingly, the inner pressure of the first sub-tank 120C is reduced from a positive pressure to a negative pressure. The control unit 80 actuates the feed pump 118C when the pressure detected by the pressure sensor 144 becomes a negative pressure below a predetermined value (for example, −0.8 kPa or less). The magnetism of the magnet 134*a* fixed to the float 134 is detected by the Hi detection sensor 136H, the feed pump 118C is stopped, thereby filling the ink storage chamber 123 of the first sub-tank 120C with the UV ink such that the UV ink reaches the filling reference level.

At the next step S50 (negative pressure keeping step), the inner pressure of the first sub-tank 120C detected by the pressure sensor 144 is reduced to be a value near the preset negative pressure (for example, about −1.0 kPa). When the inner pressure reaches this value or less, the second through fourth converging route switch valves 175M, 175Y, and 175K which have been closed until now are opened so that all of the first through fourth sub-tanks are kept at the preset negative pressure.

Then, the process proceeds to the next step S60 (wiping step) where ink droplets on a head nozzle surface (not shown) formed in the bottom of the print head 60 are removed by bringing a wiper (not shown) made of rubber or the like in contact with the head nozzle surface. Since each sub-tank is kept in the negative pressure state, meniscus is formed at each nozzle portion, thereby achieving the printable state where the ink can be ejected from nozzles.

The process proceeds to the next step S70 where the ink filling program PG is terminated. Accordingly, the first print head 60C selected by the operational panel 88 is filled with ink and all of the sub-tanks including the first sub-tank are kept at the preset negative pressure so that the standby state is held. It should be noted that, in case of carrying out the ink filling process onto a plurality of print heads, the same process as mentioned above will be carried out by turning the converging route switch valves corresponding to the print heads of which ink filling is required.

The main effects of the ink supply device 100 according to Embodiment 1 are summarized as follows.

First, in the lower portion of the sub-tank 120, the first introduction passage 127*a* and the second introduction passage 126*b* of which openings are located at different levels are provided. According to this structure, at the time of the initial filling of UV ink or the start up after nozzle cleaning with cleaning liquid, the UV ink or the cleaning liquid supplied slowly from the tube connector 128 can be introduced into the connector space 125*a* through the first introduction passage 127*a* of which opening is formed at the lower position. The UV ink introduced into the connector space 125*a* flows along the peripheral surfaces of the connector space 125*a* and the tube space 69*a* downwardly into the filter 61*b*. During this, air bubbles existing in the connector space 125*a*, the tube space 69*a*, and the filter 61*b* are introduced through the second introduction passage 126*b* into the ink storage chamber 123 and are thus removed, thereby filling these areas with the UV ink or the cleaning liquid. Since the ink storage chamber 123 is held at the negative pressure, air bubbles introduced into the ink storage chamber 123 are smoothly introduced into the line 177 through the air introduction hole 129*a* and are thus removed. By increasing the inner pressure of the sub-tank 120 to a positive pressure in this state, the passage from the sub-tank 120 to the nozzles of the print head 60 can be filled with the UV ink or the cleaning liquid without bubbles. Therefore, defective ejection is prevented and stable ink ejection is obtained.

Secondly, the magnetism of the magnet 134*a* attached to the float 134 which is accommodated in a state facing the inner wall of the float receiving portion 124 in such a manner that the float 134 can move substantially straight vertically is detected by the Hi detection sensor 136H or the Lo detection sensor 136L, thereby detecting the vertical position of the float 134, i.e. detecting the level of the UV ink stored in the ink storage chamber 123. According to this structure, the magnet 134*a* can move substantially straight vertically with the level of the UV ink, keeping in the same direction. The vertical position of the magnet 134*a* moving in the vertical direction truly reflects the level of the UV ink. Therefore, the vertical position of the magnet 134*a* is detected by detecting the magnetism of the magnet 134*a* with the Hi detection sensor 136H or the Lo detection sensor 136L, thereby precisely detecting the level of the UV ink.

Thirdly, the backflow prevention portion 132 mainly including the float supporting members 132*a* and the sealing float 133 is formed in the ink storage chamber 123 below the tube connector 129. For example, even when the float 134 and the magnet 134*a* are stuck at a level lower than the predetermined level in the float receiving portion 124 and does not move, the backflow prevention portion 132 prevents the UV ink supplied over the filling reference level from flowing into the air introduction hole 129*a*. Specifically, the UV ink supplied over the filling reference level flows into the sealing float receiving portion 132*f* and thus moves upwardly the sealing float 133 in the sealing float receiving portion 132*f*. When the upper surface of the sealing float 133 comes in contact with the lower end opening of the air introduction hole 129*a*, the sealing float 133 covers and seals the lower end opening of the air introduction hole 129*a*. Therefore, it is possible to prevent the UV ink flowing into the air introduction hole 129*a*.

Embodiment 2

Figure 13:
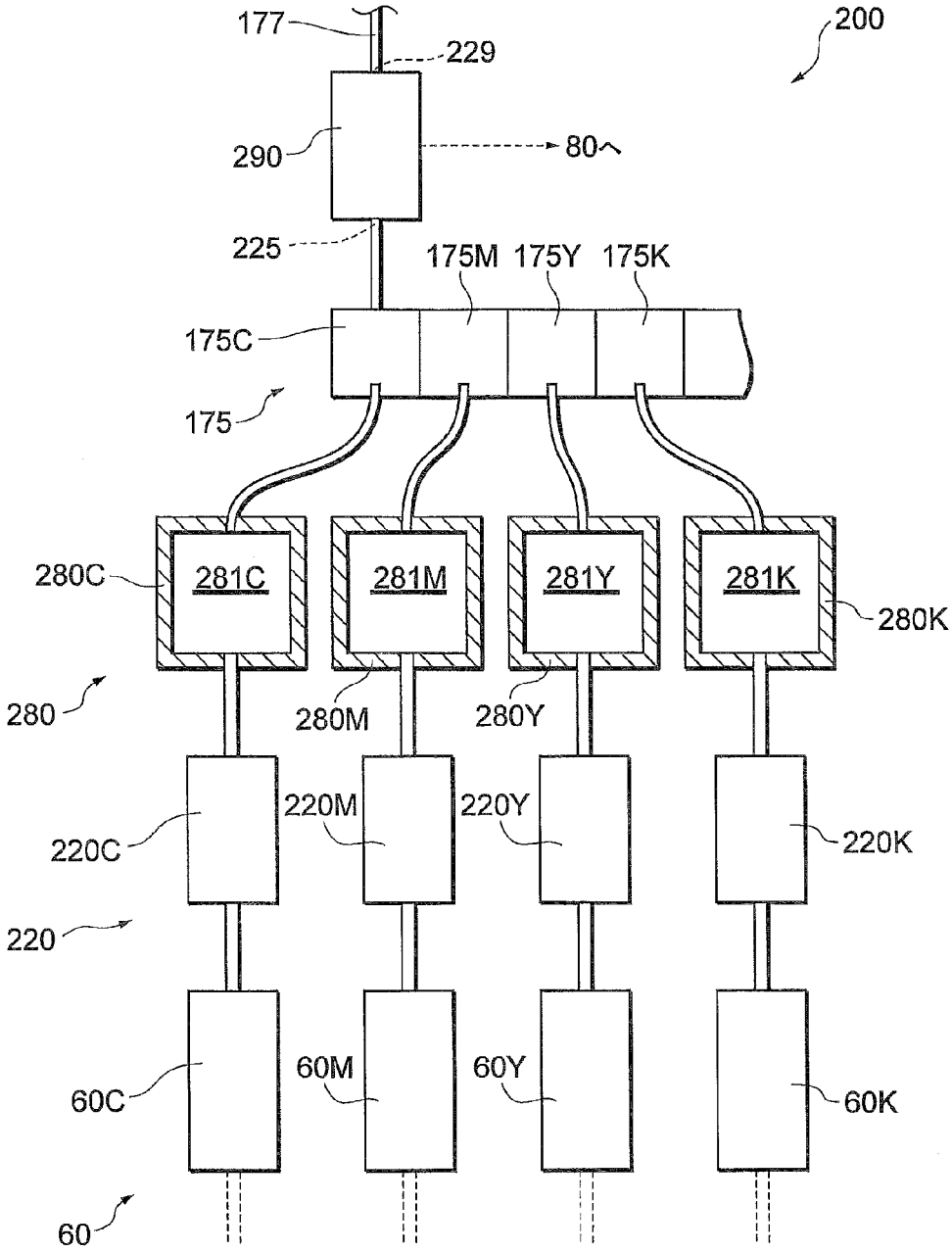
FIG. 13 is a system diagram (partly omitted) of an ink supply device according to Embodiment 2.
Figure 14:
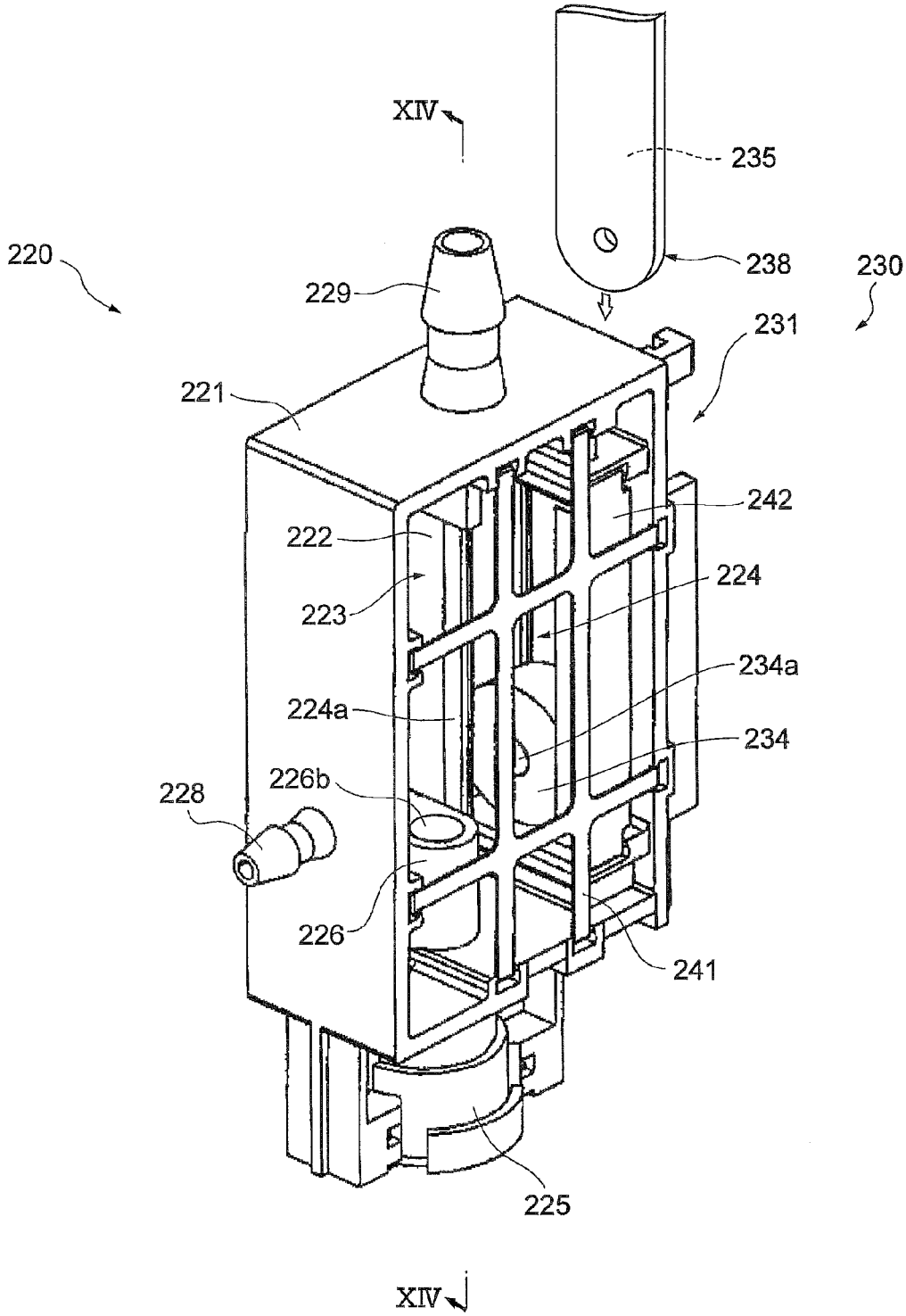
FIG. 14 is an external perspective view of a sub-tank according to Embodiment 2.
Figure 15:
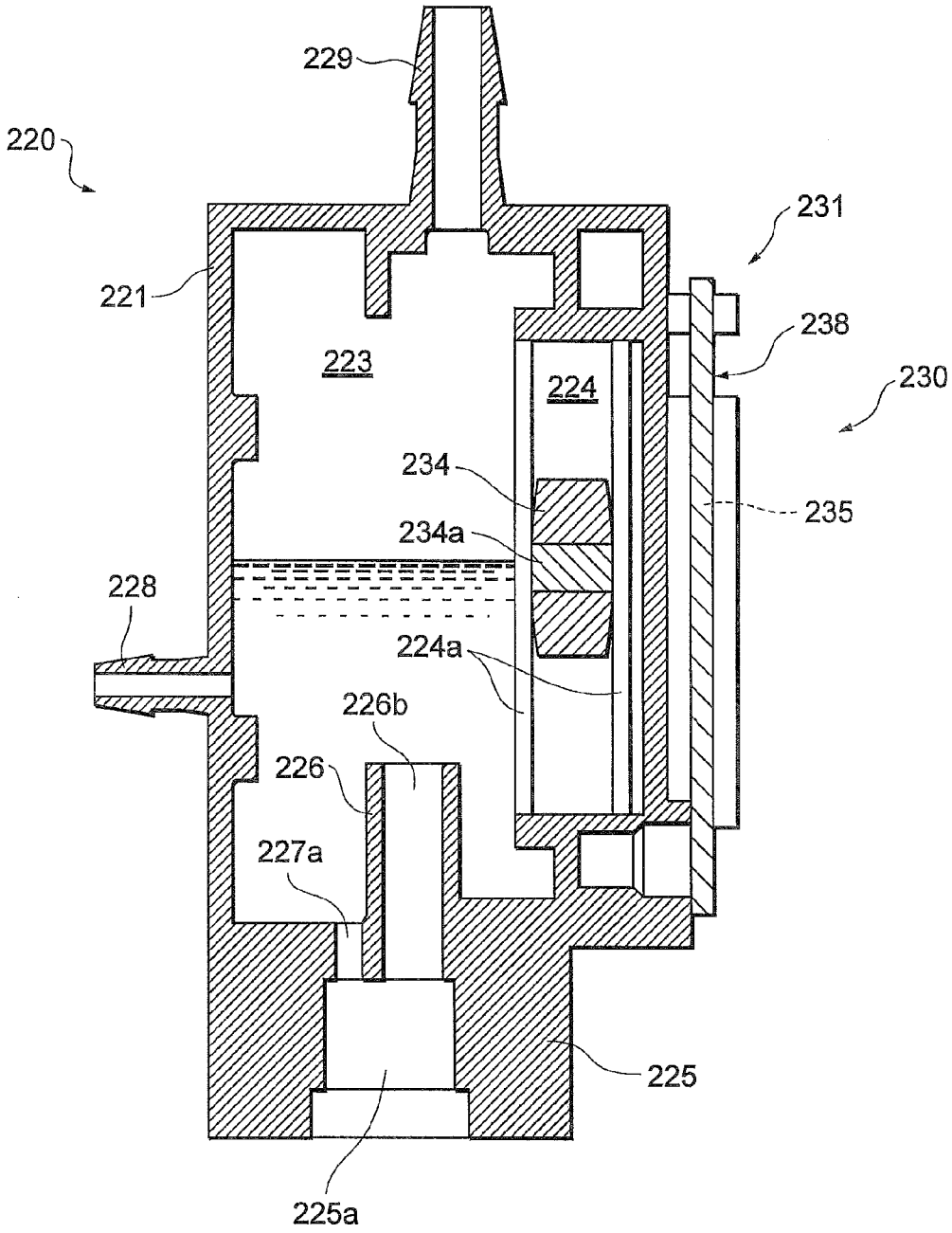
FIG. 15 is a sectional view taken along a line XIV-XIV in FIG. 14.

FIGS. 13-15 are added for the description of an ink supply device 200, which is Embodiment 2 of the present invention. Some of the structures applied in the ink supply device 200 are different from that of the ink supply device 100 according to Embodiment 1, and will be the focus of the description below, skipping similar structures as in the ink supply device 100 designated with identical reference numerals. As described above in Embodiment 1, the four systems (C, M, Y, and K) for supplying inks of respective colors have the same structure so that common components of the respective systems will be not described.

FIG. 13 shows the structure in the vicinity of the converging route switch valve 175. As known from FIG. 13, the sub-tank 220 corresponding to the print head 60 is connected to the converging route switch valve 175 via the ink storage tank 280. In the middle of the line 177 connected to the converging route switch valve 175 is provided a sub-tank 290 of the identical structure with the sub-tank 220.

The sub-tank 220, as shown in FIG. 14, mainly consists of a reservoir member 221 having a thin box-like shape which opens to the right side of the paper surface and is long in the vertical direction, a leaf spring 241 covering part of the opening of the reservoir member 221 and a lid member 222 for covering and closing the opening provided with the leaf spring 241. Inside the sub-tank 220 formed by closing with the lid member 222, an ink storage chamber 223 is formed.

On the left base of the paper surface provided with the ink storage chamber 223, two guide ribs (see FIG. 15) are formed to extend in the vertical direction. A receiving portion forming member 242 having a "ㄱ"-shaped section is disposed at the bottom left of paper surface of the guide ribs facing the guide ribs. A float receiving portion 224 which communicates with the ink storage chamber 223 and which is extending vertically on the rear side of the ink storage chamber 223 is formed by the guide ribs 224*a* and the receiving portion forming member 242. Inside the float receiving portion 124, a disc-like float 134, which has a magnet 134*a* fixed to the center thereof and floats on the UV ink, is accommodated to freely move in the vertical direction.

The sub-tank 220 includes the reservoir member 221 which is made of black resin material for example, and the film-like lid member 222 which is transparent and flexible so that the amount of UV ink stored in the ink storage chamber 223 can be observed from the outside while the light (ultraviolet light) entering the ink storage chamber 223 is reduced for control of the curing of the ink stored in the ink storage chamber 223. The leaf spring 241 made of, for instance, leaf-like metal material has the function of enhancing the strength of the film-like lid member 222.

As shown in FIG. 15, formed on the bottom side of the sub-tank 220 is a connector portion 225 projecting downwardly, in which a connector space 225*a* is formed. Above the connector portion 225, a duct portion 226 is formed to extend into the inside of the ink storage chamber 223. A first introduction passage 227*a* is formed to penetrate vertically the reservoir member 221 to connect the ink storage chamber 223 and the connector space 225*a* and a second introduction passage 226*b* is formed to penetrate vertically the duct portion 226 to connect the ink storage chamber 223 and the connector space 225*a*. Therefore, the ink storage chamber 223 and the print head 60 are connected to each other via the first introduction passage 227*a* and the second introduction passage 226*ba*.

On the rear surface of the sub-tank 220, a sub-tank reserve detecting unit 230 (see FIG. 14 and FIG. 15) for detecting the reserved state of the UV ink in the ink storage chamber 223 is provided. The sub-tank reserve detecting unit 230 includes a float 234 which is accommodated in the float receiving portion 224 and moves in the vertical direction according to the level of the UV ink in the ink storage chamber 223 and a level detection sensor 238 which detects the level of the UV ink by detecting magnetism of the magnet 234*a* fixed to the float 234. The float 234 guided by the guide ribs 224*a* moves straight in the vertical direction inside the float receiving portion 224.

As known from FIG. 14, the float receiving portion 224 is so formed that the area of its surface facing the float 234 is very small and therefore the float 234 is effectively prevented from being stuck by the UV ink to the side wall forming the float receiving portion 224, avoiding incorrect detection of the ink level.

The level detection sensor 238 accommodates a level detection plate 235 to which, for example, a Hi detection sensor (not shown) and a Lo detection sensor (not shown) capable of detecting the magnetism of the magnet 234*a* are attached. Formed on a rear wall of the reservoir member 221 is a sensor receiving portion 231 which has a groove-like shape extending in the vertical direction, and into which the level detection sensor 238 is inserted.

As FIG. 15 shows, the level detection sensor 238 is so disposed that it is inserted into the sensor receiving portion 231 and faces the float 234. The level detection sensor 238 is capable of detecting the position of the float 234 in the vertical direction by the detection of the magnetism from the magnet 234*a* of the Hi detection sensor or the Lo detection sensor, and thereby detects the level of the UV ink stored in the ink storage chamber 223. Results detected in the level detection sensor 238 are inputted into the control unit 80. On the front side of the sub-tank 220 is provided a tube connector 228 communicating with the ink storage chamber 223 and on the upper side of the sub-tank 220 is provided a tube connector 229 communicating with the ink storage chamber 223.

An ink chamber 281 for storing UV ink is formed in the ink storage tank 280. In the line 177 is provided a sub-tank 290 of which the connector portion 225 is connected to the converging route switch valve 175 and the tube connector 229 is connected to the air pump 160 side. A tub connector (equivalent to the tube connector 228) formed on a side surface of the sub-tank 290 is shut off. Results according to the level detection sensor (not shown) of the sub-tank 290 are inputted into the control unit 80.

The inner pressure of the sub-tank 220 is controlled via the ink storage tank 280 and the sub-tank 290. According to the structure, for instance, in case that the ink level is not properly detected in the sub-tank 220 and as a result the feed pump 118 excessively supplies UV ink to the ink storage chamber 223, the UV ink flowing to the side of the tube connector 229 can be temporarily stored in the ink chamber 281 to prevent the UV ink from pouring into the converging route switch valve 175 at one stroke. During the time the UV ink is stored in the ink chamber 281 (before reaching the converging route switch valve 175), the UV ink may be prevented from pouring into the converging route switch valve 175 by, for instance, shutting down the feed pump 118, hence minimizing damages arising from the inflow of UV ink to the tube connector 229.

If the UV ink has filled the ink chamber 281 as well as the converging route switch valve 175 and flows into the sub-tank 290, the level of the UV ink in the sub-tank 290 is detected and a control of stopping the drive for the feed pump 118 will be conducted based on the detection result. In this way, the UV ink is prevented from the line 147*d* and the line 157*d* to reduce damages cause by the inflow of the UV ink to the side of the tube connector 229. Also the ink storage tank 280 can be provided to replace the sub-tank 290, which will reduce the production costs and at the same time will minimize to the greatest extent damages arising from the UV ink flowing into the tube connector 229.

Though the structure in which the level detection sensor 138 is detachable relative to the sub-tank 120 has been described in Embodiment 1, the Hi detection sensor 136H, the Lo detection sensor 136L and the level detection plate 135 may be assembled into the sub tank 120, for example. The sub-tank 220 according to Embodiment 2 may be of such a structure as well.

Figure 11:
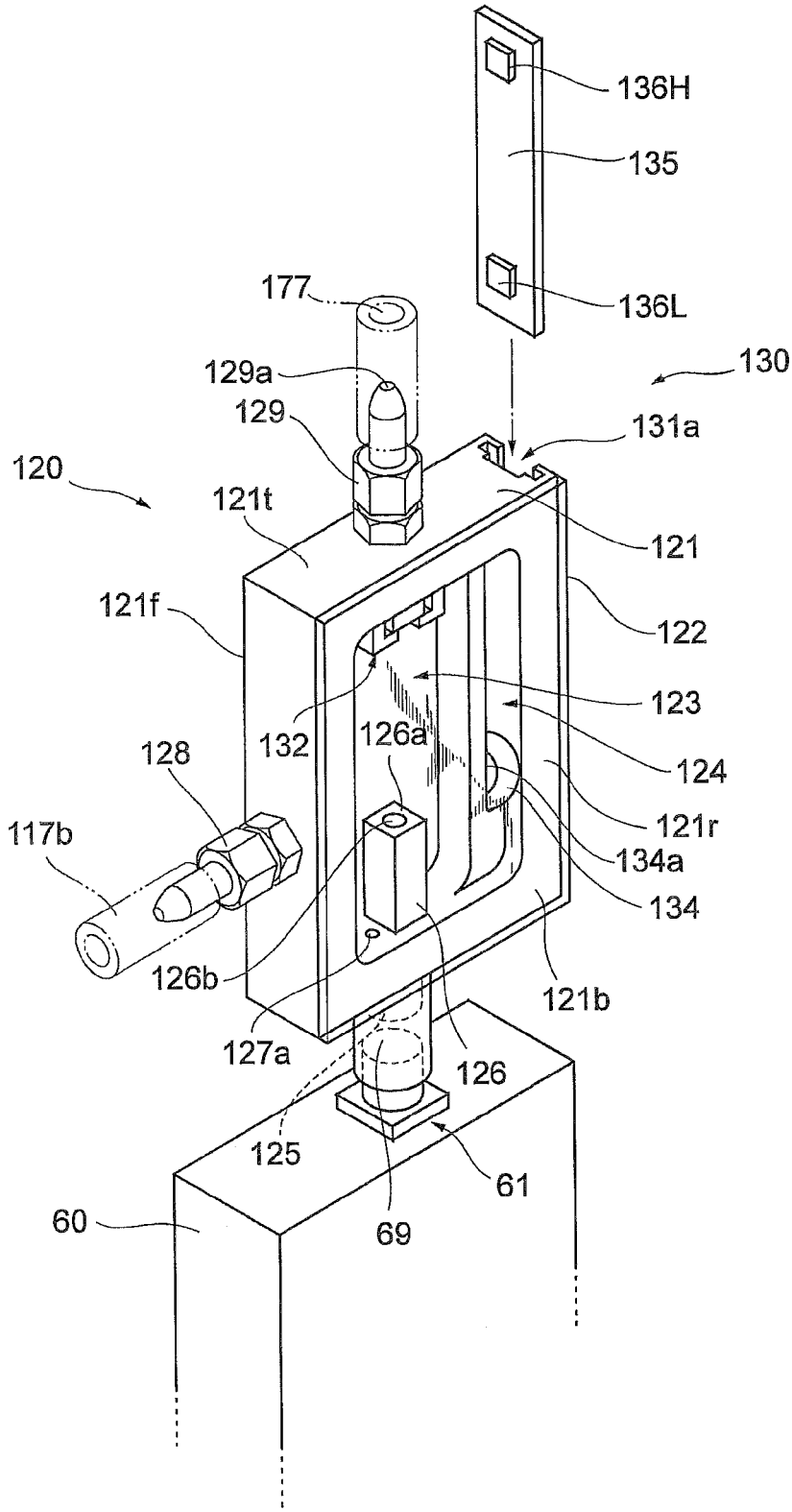
FIG. 11 is a perspective view showing a variation example of a level detection sensor.

Though the level detection sensor 138 in which the level detection plate 135 is accommodated in the casing member 137 has been described in Embodiment 1, the level detection sensor 138 is not limited thereto. A structure as shown in FIG. 11 may be utilized where the level detection plate 135 is not accommodated in the casing member 137, but is mounted to a sensor receiving portion 131*a* which is formed into a shape corresponding to the shape of the level detection plate 135. The sub-tank 220 according to Embodiment 2 may be of such a structure as well.

Figure 12:
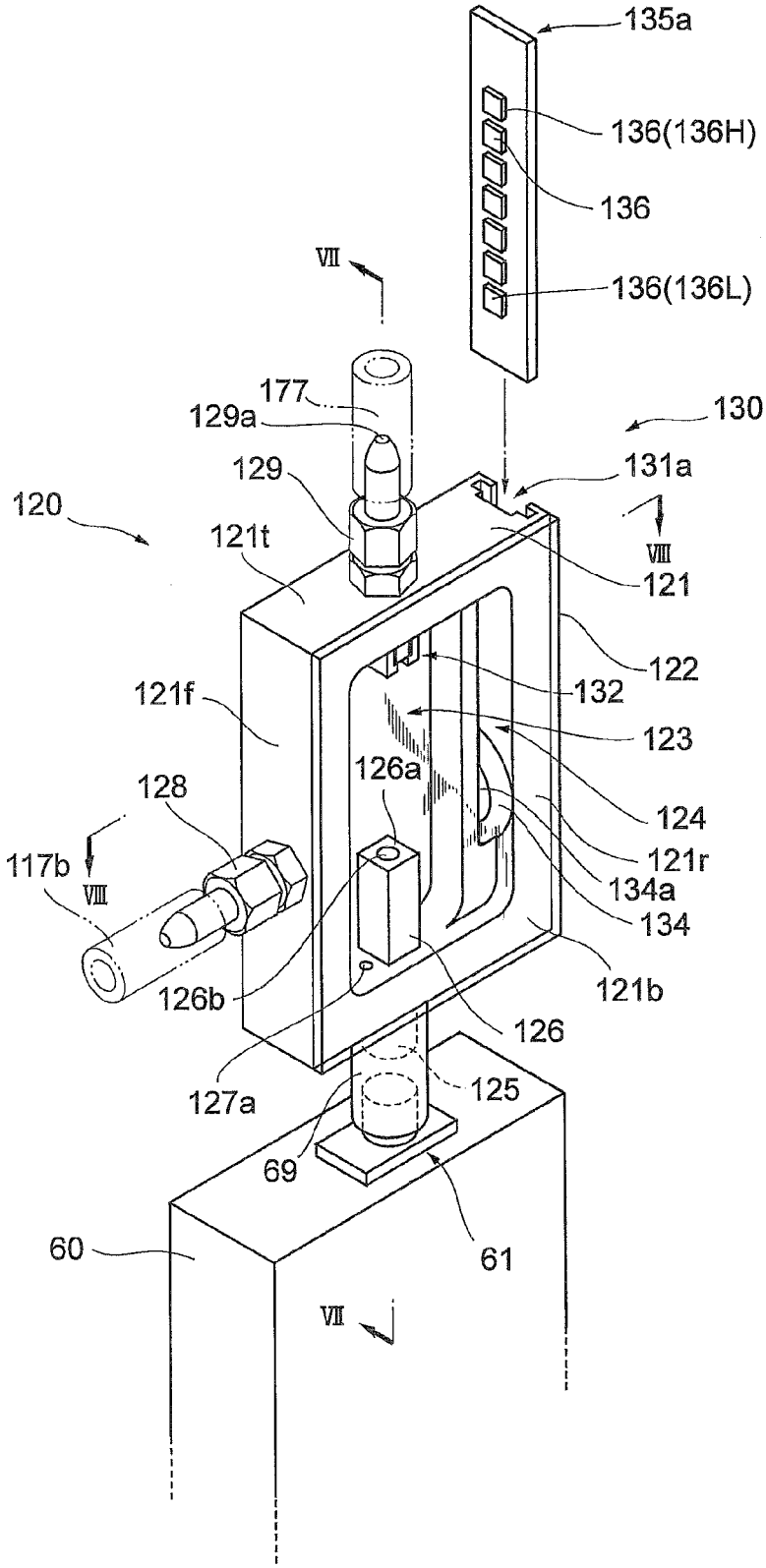
FIG. 12 is a perspective view showing a variation example of a level detection sensor.

Though a structure employing the Hi detection sensor 136H and the Lo detection sensor 136L has been presented in Embodiment 1, the structure is not limited thereto. For example, as shown in FIG. 12, such a structure may be employed that a level detection plate 135*a* having three or more detection sensors 136 disposed to be aligned in the vertical direction is mounted to the sensor receiving portion 131*a*, or that the level detection plate 135*a* is so provided in the sub-tank 120 that it is accommodated in the casing member 137. The structure enables a detailed detection of the UV ink level in the ink storage chamber 123, and enables such a control that the operator is informed of the next necessary process predicted from, for example, the temporal development of the UV ink residual based on the detected level. The sub-tank 220 according to Embodiment 2 may be of such a structure as well.

Though a structure provided with the first introduction passage 127*a* and the second introduction passage 126*b* which connect the ink storage chamber 123 and the connector space 125*a* has been presented in Embodiment 1, the present invention shall not be interpreted to be limited thereto. For example, such a structure may be employed that three introduction passages are formed to connect the ink storage chamber 123 and the connector connector space 125*a*, at least two of the three introduction passages having their openings on the ink storage chamber 123 side formed at different heights, or that four or more introduction passages are formed, at least two of the four or more introduction passages having their openings on the ink storage chamber 123 side formed at different heights. The sub-tank 220 according to Embodiment 2 may be of such a structure as well.

Though as the inkjet printer to which the two embodiments of the present invention are applied, the UV curable-type inkjet printer of which one axis is used for moving a print medium and the other axis is used for moving a print head is employed in Embodiment 1 and Embodiment 2, the present invention can be applied to an inkjet printer of another type, such as an inkjet printer of which two axes are used for moving a print head, an inkjet printer of which two axes are used for moving a print medium, or an inkjet printer using ink of another type such as dye ink or pigment ink.

It is preferable that the ink chamber consists of a supply ink chamber (for example, the ink storage chamber 123 in the embodiments) and a detection ink chamber (for example, the float receiving portion 124 in the embodiments) communicating with each other, wherein an ink inlet opening (for example, the tube connector 128 in the embodiments) which is connected to the main tank is formed in communication with the supply ink chamber, and a level indicator member (for example, the magnet 134*a* in the embodiments) which is received in the detection ink chamber floats on the liquid ink and freely moves up and down.

The level indicator member, in a state of being received in the detection ink chamber, preferably faces the internal wall which defines the ink chamber.

It is preferable that guide projections (for example, the guide ribs 224*a* in the embodiments) projecting in the inward direction of the ink chamber and extending in the vertical direction are formed on the internal wall, and the level indicator member is received in the detection ink chamber enclosed by the guide projections and is capable of freely moving up and down.

The sub-tank preferably includes a level detection portion (for example, the level detection sensor 138 in the embodiments) which detects the ink level of the ink chamber by detecting the position of the level indicator member in the perpendicular direction.

The sub-tank is of such a preferable structure that the level detection portion is removable.

It is further preferable that the level indicator member includes a magnet, and the level detection portion includes magnetic sensors (for example, the Hi detection sensor 136H and the Lo detection sensor 136L in the embodiments) which detect magnetism from the magnet to detect the prescribed position of the magnet in the perpendicular direction.

The magnetic sensors are preferably disposed at positions of upper and lower limits of the ink level in the ink chamber.

Besides, it is preferable that in the ink supply device for an inkjet printer, a pressure control hole (for example, the air introduction hole 129*a* in the embodiments) is formed in communication with the supply ink chamber, which is connected to the inner pressure controller (for example, the sub-tank depressurizing unit 140 and the sub-tank pressurizing unit 150 in the embodiments) for controlling the inner pressure of the ink chamber. In the ink chamber is formed a backflow prevention portion including a sealing member (for example, the sealing float 133 in the embodiments) which floats on the liquid ink, and a supporting portion (for example, float supporting members 132*a* in the embodiments) which supports the sealing member in a way that the supporting portion freely moves in the vertical direction in response to changes of the ink level in the ink chamber, and which seals an ink chamber-side opening of the pressure control hole when the sealing member moves upwardly according to the rise of the ink level in the ink chamber.

It is also preferable that the ink chamber-side opening opens at the upper wall surface of the sub-tank, the supporting portion is so formed that it surrounds the ink chamber-side opening and is meanwhile connected to the upper wall surface to extend downwardly, and the sealing member is held at the supporting portion and is located below the ink chamber-side opening.

An inner pressure adjusting passage (for example, the line 177 in the embodiments) connecting the sub-tank with the inner pressure controller is preferably provided with an inner pressure control valve (for example, the converging route switch valve 175 in the embodiments) capable of being switched on or off, and an upstream-side ink storage member (for example, the ink storage tank 280 in the embodiments) is provided between the inner pressure control valve and the sub-tank, in which is formed an upstream-side ink chamber (for example, the ink chamber 281 in the embodiments) capable of storing liquid ink.

The sub-tank is preferably provided between the inner pressure control valve of the inner pressure adjusting passage and the inner pressure controller.

An inkjet printer according to an embodiment of the present invention is equipped with the ink supply device in the aforementioned structure for an inkjet printer.

Preferably, the inkjet printer consists of a body member (for example, the apparatus body 1 in the embodiments) having a medium supporting portion (for example, the platen 20 in the embodiments) for supporting print medium, and a carriage so disposed that it faces the print medium supported by the medium supporting portion and is movable relative to the body member, with the main tank being provided on the body member while the print head and the sub-tank being provided on the carriage.

In the ink supply device for an inkjet printer according to the embodiment of the present invention are formed a plurality of supply holes which lead from the ink chamber to the head-side supply passage, at lease two of the plurality of supply holes having their openings on the ink chamber side formed at different heights in the inward direction of the ink chamber. According to this structure, when for example the head-side supply passage and the print head from which ink has been exhausted are to be filled with ink, transmission of ink to the print head can be conducted through the head-side supply passage from supply hole(s) of the plurality of supply holes having their openings on the ink chamber side formed at lower height. Thereby those air bubbles remaining in the head-side supply passage and the print head are driven little by little to the head-side supply passage, and are then discharged into the ink chamber through supply hole(s) of the plurality of supply holes having their openings on the ink chamber side formed at higher height. In this way the structure enables stable ink ejection with the head-side supply passage and the print head filled with the ink and containing no air bubble.

Preferably the ink chamber consists of a supply ink chamber and a detection ink chamber communicating with each other, and a level indicator member received in the detection ink chamber moves freely up and down. For instance, by making the supply ink chamber larger than the detection ink chamber, the detection ink chamber may receive a smaller level indicator member to detect the ink level, while the larger supply ink chamber may store more ink. Therefore, detection of the ink level is effected in an ink chamber of high capacity for ink storage.

Furthermore, the level indicator member is preferably configured to face the internal wall defining the ink chamber. This structure enables the level indicator member to move straight in the vertical direction of the detection ink chamber along the internal wall in correspondence with the ink level, without any rotation or sway. The level of ink in the ink chamber can be hereby precisely detected.

Preferably, the level indicator member is received in the detection ink chamber enclosed by guide projections which are provided on the internal wall extending along the perpendicular direction. Such a design reduces the contact surface between the level indicator member and the internal wall to prevent, for instance, the level indicator member from sticking to the internal wall so that the ink level is precisely detected in the ink chamber.

The sub-tank preferably includes a level detection portion which detects the ink level of the ink chamber by detecting the position of the level indicator member in the perpendicular direction. It is unnecessary, for example, to provide additional detection means in the surround of the sub-tank as the ink level detection can be achieved within the sub-tank. The design thus allows a compact sub-tank (the ink supply device).

Preferably, the sub-tank is so configured that the level detection portion is removable, which makes operations of replacing and maintaining the level detection portion simple and easy.

The level detection portion preferably includes magnetic sensors which detect magnetism from the magnet provided on the level indicator member to detect the prescribed position of the magnet in the perpendicular direction. Magnetism from the magnet is capable of penetrating through the ink to be detected by the magnetic sensors, and accordingly the use of magnetic sensors makes the detection of the ink level not limited by the ink category (like colors and properties).

The magnetic sensors are preferably disposed at positions of upper and lower limits of the ink level in the ink chamber. It enables controls such as: starting supply to the ink chamber upon the magnetic sensor at the lower limit detecting magnetism and stopping the ink supply upon the magnetic sensor at the upper limit detecting magnetism. These controls of ink supply are simple but efficient in guaranteeing that the ink chamber always stores a prescribed volume of ink.

In the ink supply device for an inkjet printer, the sealing member is preferably configured so that it seals an ink chamber-side opening of the pressure control hole when moving upwardly according to the rise of the ink level in the ink chamber. In the event that, for example, ink is excessively supplied to overflow the ink chamber, the sealing member is capable of sealing an ink chamber-side opening of the pressure control hole before the overflowing ink reaches the ink chamber-side opening. Consequently, this configuration can prevent ink from flowing to the pressure controller side even in the event of excessive ink supply so as to continue the inner pressure adjustment in the ink chamber.

It is preferable that the supporting portion is so formed that it surrounds the ink chamber-side opening and extends downwardly, and the sealing member is held at the supporting portion and is located below the ink chamber-side opening. As the sealing member moves straight upwardly from the location where it is held by the supporting portion according to the rise of the ink level in the ink chamber, it whereby seals the ink chamber-side opening. Since no complex move is needed for the sealing member to seal the ink chamber-side opening, the ink is reliably prevented from flowing into the pressure controller. Bedsides, costs can be reduced due to the supporting portion made in simple shape.

An upstream-side ink storage member capable of storing liquid ink is preferably provided between the inner pressure control valve of the inner pressure adjusting passage and the sub-tank. In case ink is excessively supplied to the sub-tank to flow into the inner pressure adjustment passage, it can be temporarily stored in the upstream-side ink storage member to retard the ink reaching the inner pressure control valve (to buy time). During the time ink is stored in the upstream-side ink storage member, the ink may be prevented from flowing into the inner pressure control valve by, for instance, stopping the ink supply to the sub-tank.

Furthermore, the sub-tank is preferably provided between the inner pressure control valve of the inner pressure adjusting passage and the inner pressure controller. This design, with the sub-tank being equipped with the level detection portion, enables for instance the control of stopping the ink supply to the sub-tank connected to the print head when ink inflow is detected in the sub-tank. Hence the flow of ink to the inner pressure controller is prevented to avoid damages caused by the flow of ink to the inner pressure adjustment passage.

The inkjet printer according to the embodiment of the present invention is configured so that it is equipped with the ink supply device of the aforementioned structure for an inkjet printer. In the inkjet printer so configured, ink is stably supplied from the sub-tank to the print head thus avoiding any defective ejection like ejection of air bubbles, and since the ink is precisely ejected from the print head, high-quality printing is made possible.

In addition, it is preferable that in the inkjet printer, the main tank is disposed in the body member while the print head and the sub-tank in the carriage. Such a structure sets the sub-tank heavier with a large volume of ink at the fixed body member instead of the carriage which is movable relative to the print medium, so that the weight of the carriage equipped with instruments and members is decreased. Thank to the lighter carriage, a simple and cheap moving mechanism is competent for moving the carriage relatively.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An ink supply device for an inkjet printer, comprising:

a sub-tank having an ink chamber to store liquid ink and to be connected to a print head configured to eject the liquid ink via a head-side supply passage, the sub-tank having a plurality of supply holes which connect the ink chamber and the head-side supply passage, at least two of the plurality of supply holes having their openings on the ink chamber side formed at different heights; and a main tank connected to the sub-tank and to contain the liquid ink to be supplied to the ink chamber, wherein the ink chamber has a supply ink chamber and a detection ink chamber communicating with each other, the supply ink chamber communicating with an ink inlet opening connected to the main tank, the detection ink chamber receiving a level indicator member floating on the liquid ink to freely move in a vertical direction, and wherein the sub-tank comprises a level detection portion configured to detect an ink level of the ink chamber by detecting a position of the level indicator member in the vertical direction.

2. The ink supply device for an inkjet printer according to claim 1, wherein the level detection portion of the sub-tank is removable.

3. The ink supply device for an inkjet printer according to claim 1, wherein the level indicator member comprises a magnet; and the level detection portion comprises magnetic sensors configured to detect magnetism from the magnet to detect a prescribed position of the magnet in the vertical direction.

4. The ink supply device for an inkjet printer according to claim 3, wherein the magnetic sensors are disposed at positions of upper and lower limits of the ink level in the ink chamber.

5. An inkjet printer equipped with the ink supply device for an inkjet printer according to claim 1.

6. The inkjet printer according to claim 5, comprising:

a body member having a medium supporting portion to support a print medium, the main tank being provided on the body member; and a carriage to face the print medium supported by the medium supporting portion and to be movable relative to the body member, the print head and the sub-tank being provided on the carriage.

7. The ink supply device for an inkjet printer according to claim 1, wherein the level indicator member is received in the detection ink chamber and faces an internal wall which defines the ink chamber.

8. The ink supply device for an inkjet printer according to claim 7, wherein a guide projection projecting in an inward direction of the ink chamber and extending in the vertical direction is formed on the internal wall; and the level indicator member is enclosed by the guide projection in the detection ink chamber to freely move in the vertical direction.

9. The ink supply device for an inkjet printer according to claim 7, wherein the level detection portion of the sub-tank is removable.

10. The ink supply device for an inkjet printer according to claim 1, wherein a guide projection projecting in an inward direction of the ink chamber and extending in the vertical direction is formed on the internal wall; and the level indicator member is enclosed by the guide projection in the detection ink chamber to freely move in the vertical direction.

11. The ink supply device for an inkjet printer according to claim 10, wherein the level detection portion of the sub-tank is removable.

12. An ink supply device for an inkjet printer, comprising:

a sub-tank having an ink chamber to store liquid ink and to be connected to a print head configured to eject the liquid ink via a head-side supply passage, the sub-tank having a plurality of supply holes which connect the ink chamber and the head-side supply passage, at least two of the plurality of supply holes having their openings on the ink chamber side formed at different heights; and a main tank connected to the sub-tank and to contain the liquid ink to be supplied to the ink chamber, wherein the ink chamber has a supply ink chamber and a detection ink chamber communicating with each other, the supply ink chamber communicating with an ink inlet opening connected to the main tank, the detection ink chamber receiving a level indicator member floating on the liquid ink to freely move in a vertical direction, wherein the supply ink chamber communicates with a pressure control hole connected to an inner pressure controller configured to control an inner pressure of the ink chamber, wherein a backflow prevention portion is formed in the ink chamber, the backflow prevention portion comprising a sealing member which floats on the liquid ink and a supporting portion which supports the sealing member to freely move the sealing member in the vertical direction in response to changes of an ink level in the ink chamber, and wherein the sealing member seals an ink chamber-side opening of the pressure control hole when the sealing member moves upwardly according to rise of the ink level in the ink chamber.

13. The ink supply device for an inkjet printer according to claim 12, wherein the ink chamber-side opening opens at an upper wall surface of the sub-tank;

the supporting portion is disposed to surround the ink chamber-side opening and is connected to the upper wall surface to extend downwardly; and the sealing member is held at the supporting portion and is located below the ink chamber-side opening.

14. The ink supply device for an inkjet printer according to claim 12, wherein an inner pressure adjusting passage connecting the sub-tank with the inner pressure controller comprises an inner pressure control valve to be switched on and off; and an upstream-side ink storage member in which an upstream-side ink chamber to store liquid ink is formed is provided between the inner pressure control valve and the sub-tank.

15. The ink supply device for an inkjet printer according to claim 14, wherein the sub-tank is provided between the inner pressure control valve of the inner pressure adjusting passage and the inner pressure controller.

* * * * *